US005080368A

United States Patent [19]

Weisser

[11] Patent Number: 5,080,368

[45] Date of Patent: Jan. 14, 1992

[54] METHOD OF PLAYING GAME

[76] Inventor: Carl Weisser, 38 Livingston St., Apt. 33, Brooklyn, N.Y. 11201

[21] Appl. No.: 676,846

[22] Filed: Mar. 28, 1991

Related U.S. Application Data

[60] Division of Ser. No. 512,096. Apr. 10, 1990, Pat. No. 5,026,068, and a continuation of Ser. No. 155,370, Feb. 12, 1988, abandoned.

[51] Int. Cl.[5] ..... A63F 3/00

[52] U.S. Cl. ..... 273/241; 273/258; 273/285

[58] Field of Search ..... 273/241, 249, 248, 258, 273/261, 263, 264

[56] References Cited

U.S. PATENT DOCUMENTS 3,901,512 8/1975 Fekete ..... 273/249
4,013,294 3/1977 Smeda et al. ..... 273/249
4,046,381 9/1977 Comeaux ..... 273/249
4,223,892 9/1980 Matherne ..... 273/249

*Primary Examiner*—Benjamin Layno
*Attorney, Agent, or Firm*—Amster, Rothstein & Ebenstein

[57] ABSTRACT

Game equipment, such as board game apparatus, includes a game display, a plurality of sets of game pieces, a recruitment determining device and optionally, several player game pieces. The game display provides a playing area defined by a plurality of basic space units arranged in one or a plurality of levels. The basic space units in each level are arranged to form a plurality of pyramid modules each module including a number of stages of basic space units. The number of basic space units in each stage is determined by a geometric progression of a type used in some "pyramid" or "Ponzi" schemes.

8 Claims, 23 Drawing Sheets

FIG. 1
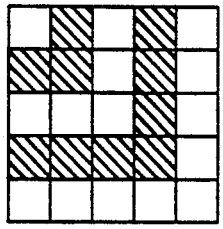
FIG. 2
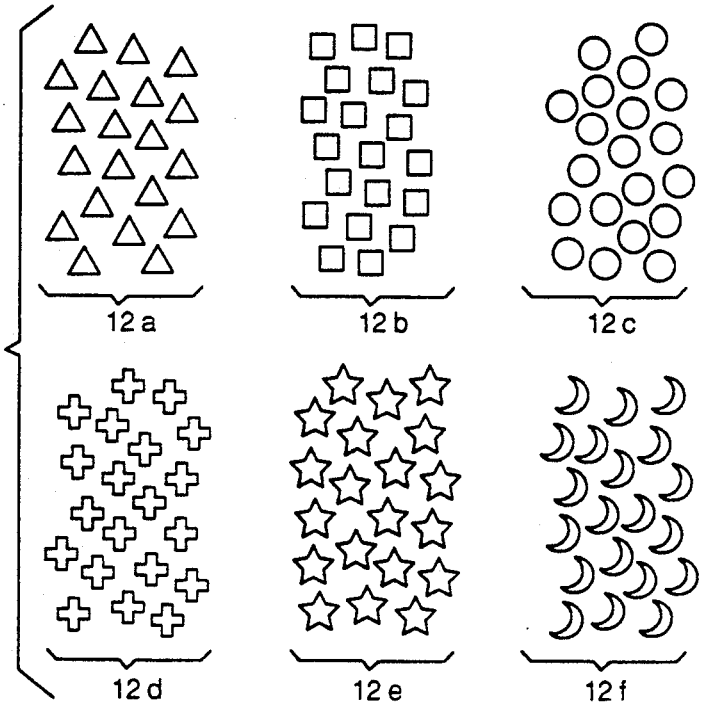
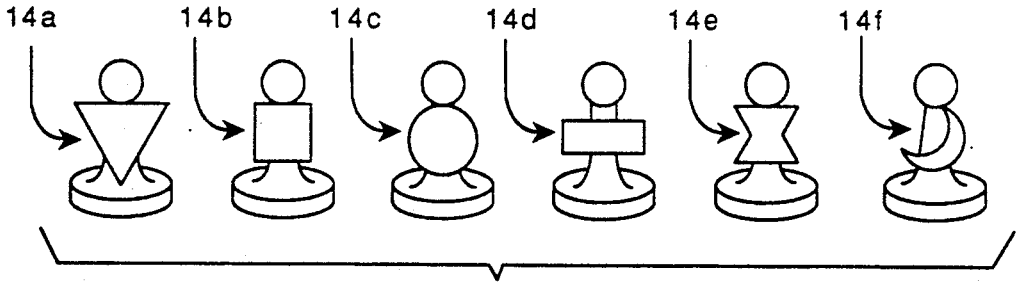
FIG. 3
FIG. 4
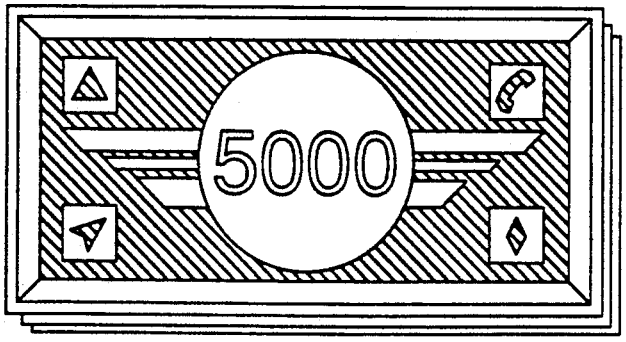
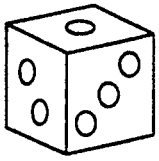
FIG. 5

$2^n$ $3^n$ $4^n$

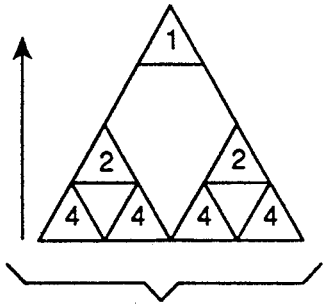
ONE-DIRECTIONAL
FIG. 32
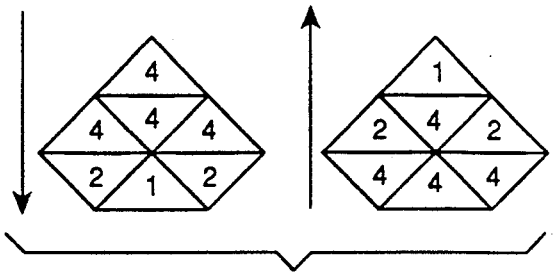
TWO-DIRECTIONAL
FIG. 33
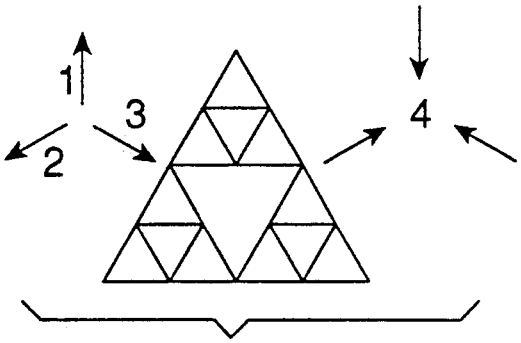
FOUR-DIRECTIONAL
FIG. 34
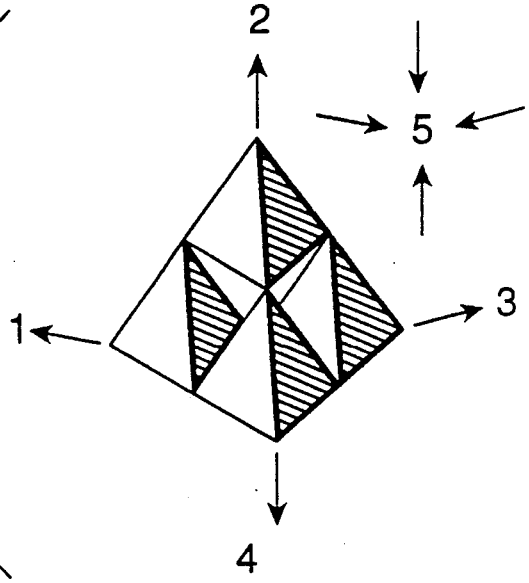
FIVE-DIRECTIONAL
FIG. 35
FIG. 36
SEVEN-DIRECTIONAL
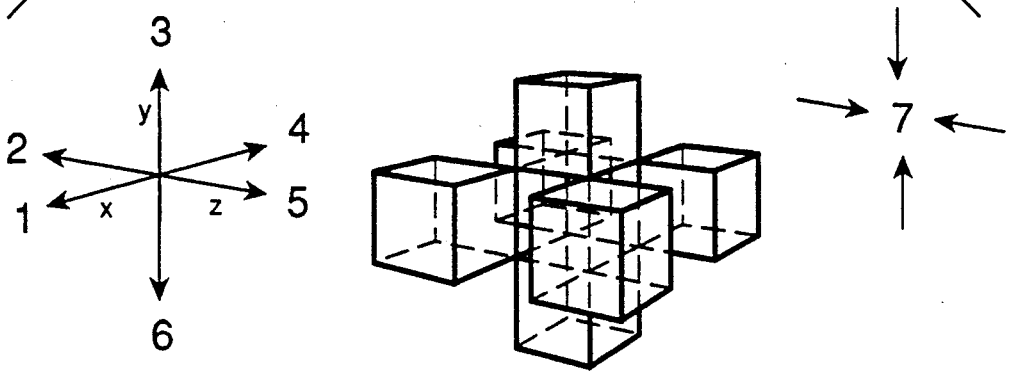

FIG. 85A CONTINUES TO FIG. 85B

FIG. 85A
FIG. 85B CONTINUES FROM
FIG. 85B
STEP 3B
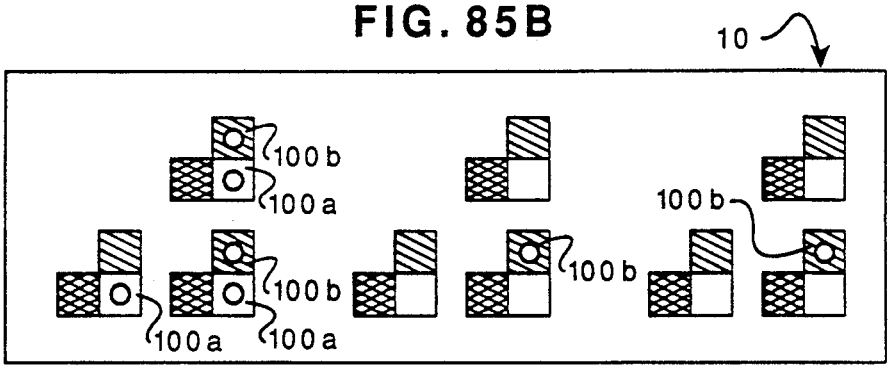
STEP 4B
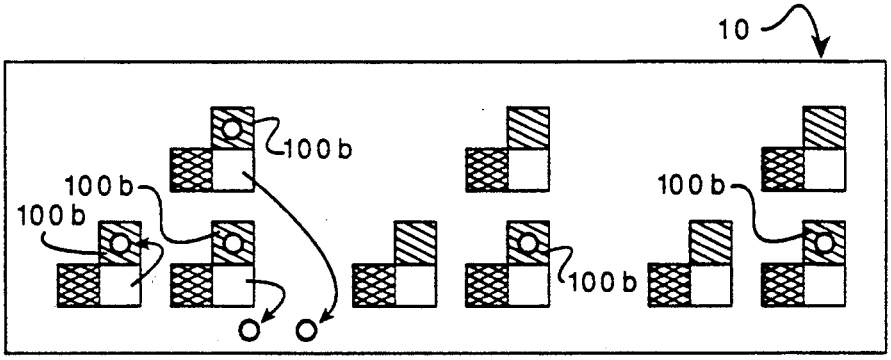
STEP 5
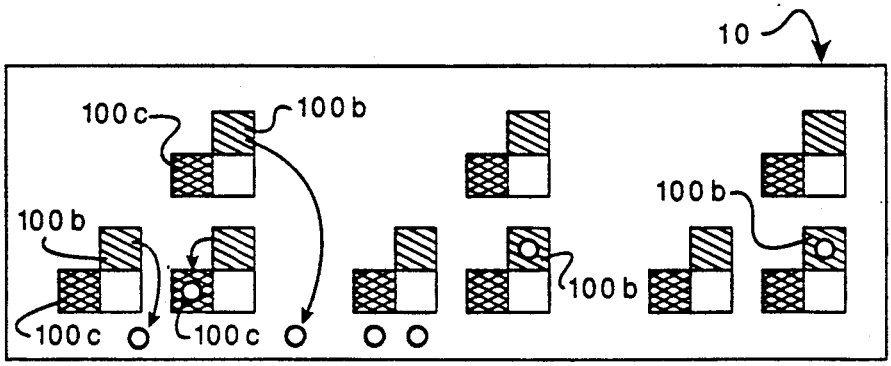

METHOD OF PLAYING GAME

CROSS-REFERENCE TO RELATED APPLICATIONS

This is a divisional of U.S. patent application Ser. No. 512,096, filed Apr. 10, 1990, now U.S. Pat. No. 5,026,068, which is a continuation of U.S. patent application Ser. No. 155,370, filed Feb. 12, 1988, now abandoned.

BACKGROUND OF THE INVENTION

This invention relates generally to game equipment, such as board game and video game equipment.

Game equipment of all types and kinds exist which simulate various real life situations. For example, game equipment which simulate sporting events, such as baseball, football and basketball, business endeavors, such as real estate, career advancement and the stock market, and socio-political events, such as war, are all known.

To the applicant's knowledge, although one game was found which refers to pyramid money schemes in its game terminology, neither that game nor any other utilizes in any dynamic way the mechanisms of "pyramids" herein applied for. Such pyramid schemes, also sometimes referred to as "ponzi" schemes, generally comprise a program which utilizes a pyramid or chain process, i.e., a process which utilizes a geometric progression, by which a participant in the program gives valuable consideration, usually a sum of money, for the opportunity or right to receive compensation in return for inducing other persons to become participants for the purpose of gaining new participants in the program. Each participant moves up through the pyramid, having paid an initial sum of money either to one person at the top of the pyramid or in portions to several persons at different levels above the first level. As the participant moves up, he/she either receives progressively larger payoffs or one large payoff if and when he/she reaches the top of the pyramid. The number of levels varies with different forms of pyramid programs. Although legislation has been enacted in several states which made the promotion of such schemes illegal, they still proliferate in the form, for example, of chain letters and empty security investments where the only positive cash flow results from the constant and essential recruitment of new investors. Some forms of pyramid schemes have been allowed to exist legally because a product is sold apart from the game itself, usually for less than $100.00.

A form of pyramid scheme which has recently come into vogue is called "The Airplane Game." In this version of the pyramid scheme, a player makes only one payment, to the person at the top of the pyramid. Using the jargon of the participants in the Airplane Game, the basic scheme works as follows: at a top a pyramid (or "airplane") is the Pilot; two Co-Pilots are on the second level of the pyramid or airplane; on the third level are four Crew Members; and on the fourth level are eight Passengers. The game actually originates when someone decides to be a Pilot and succeeds in recruiting two Co-Pilots who in turn recruit four Crew Members, and so on. The first pilot may make the most money on one round on one airplane because he or she may be paid not only by the Passengers but also the Crew and Co-Pilots; but that Pilot is also at greatest risk legally for starting the game in the first place. For most people, however, the game starts at the Passenger level. When eight Passengers have been recruited for the airplane by the Pilot, Co-Pilots and/or Crew Members, with each Passenger paying a sum of money to the Pilot, the Pilot "pilots out" of the program. The airplane then "splits" into two airplanes and each Co-Pilot "moves up" and becomes a Pilot of his own airplane. The four Crew Members separate into two pairs, each pair "moving up" to become Co-Pilots of a respective one of the two new airplanes. The eight Passengers who have just paid their money separate into two groups of four, each group "moving up" to become Crew Members of a respective one of the two new airplanes. At this point, everybody on board both of the airplanes begins recruiting eight new Passengers for each airplane.

If the game is infinite, there is no problem. In fact, a reasonable theoretical case might be made for the game proceeding indefinitely if it were brought in line with population growth rates and perhaps with the posting of a more realistic appraisal of the rate of return odds similar to legalized casino and racetrack gambling. [A pyramid scheme in fact, is not "gambling" per se, in that participants do not wager on an event outside their control with multiple outomes. Using a horse race analogy, a player in a pyramid scheme is wagering on a "horse" that the player is himself riding. In a general sense, the "gamble" is whether one can get in and out not only before the "bottoming out" comes, but also before one's friends get stuck as well.] The pace generally required for the Airplane Game to sustain interest and momentum, together with the necessity for recruitment, probably pushes the game to an early saturation point wherein the networks of participants so overlap that the supply of new and willing participants within a given time period and limited geographic area is essentially exhausted. Therefore legislation has been enacted making most of these pyramid games illegal, and police departments tend to shorten the effective game-playing time period by breaking up meetings when the numbers get too big.

An intense debate ensued in some circles as to whether this was a finite or infinite game, whether the game could work constructively if allowed to develop and evolve on its own without interference, and whether the game could be effectively assimilated into the already existing body of institutionalized pyramid variants, such as in the stock market, in political campaigns and elections, in tax structures and the federal budget. Those who believed in "the game" and those who did not, often became polarized. Aside from the issues of legality and mathematics, what may be most needed that is lacking in this and other pyramid schemes is the funding, promoting, and sponsoring of something of greater intrinsic value to the participants than the money they "invest." Some of the preferred embodiments of the game invention presented below take into account all of the above considerations.

Although from a legal point of view participation in actual pyramid of Ponzi schemes may not be advisable, the mechanism by which one "moves up" through a pyramid in accordance with a process which utilizes a geometric progressions is rather fascinating, and participating in the process in some benign way could be educational for children and adults especially those who might have difficulty visualizing a geometric progression when only tempted with an attractive piece of it.

It would be desirable therefore, to provide game equipment that in its play simulates the mechanism by which a participant "moves up" through a pyramid, and additionally to provide game equipment which simulates the dynamic interplay of population size and limited time-space events, wherein competition and/or cooperation interact with opportunities for growth or expansion, laws of diminishing returns, and saturation points.

Various games exist which incorporate the shape of a triangle or pyramid on the board without using a geometric progression. Some of these games refer to Pharoahs and Egyptian pyramids using a maze or labyrinth gameboard path. Other games have boards with space units laid out in arithmetic progressions (FIG. 1) which do not afford a repeated "split" into two new pyramids as do geometric progressions. Webster's New World Dictionary defines geometric progression as "a sequence of terms in which the ratio of each term to the preceding one is the same throughout the sequence." An example would be 2, 4, 8, 16, etc. An arithmetic progression is defined as "a sequence of terms each of which, after the first, is derived by adding to the preceding one a constant quantity." An example would be 1, 2, 3, etc.

Game boards do exist whereupon space units are arranged in geometric progressions, and the filling up of one row before moving up to the next row is a requirement of play. The number of space units filled by each player is usually determined by a chance device such as dice or a spinner, or by instructional cards. However, in all of the games searched by this applicant, only the player's own game piece moved up the pyramid. The filling of other space units was only implied, and the player game piece moved up the pyramid usually in a serial manner.

A variation of this was found in which all the spaces are covered by money chips and the player advances his game piece by spinning his color, removing arbitrarily or in sequence the money chips on one space in a given row and placing his game piece there, continuing in like fashion until all spaces of his color are exposed on that row, then advancing the game piece to the next row. (Copyright Registration No. VA 19-856). One could argue that this represents the pyramid money scheme if one imagines that each time the game piece moves and the player collects money chips, he/she is collecting the payoffs which, when all are collected from a given row means that row is filled and this advances the player to the next higher row, there to collect more payoffs, and so on. If one imagines even further, the money chips in each row therefore represent money from a new player filling a space on the bottom row and paying that portion upward in order to fulfill the "payoff" requirements that may get progressively larger as one moves up the pyramid simply because there are fewer recipients of the portion earmarked for each higher row, even if that portion is the same.

Again however, the only game pieces that actually move up are the individual game pieces of the respective players. The rest of the pyramid process in terms of actual movement, is at best implied.

Another "pyramid" game was found (copyright Registration No. VA 71-489) which actually refers to pyramid money schemes in its play. The game board is arranged, not in a triangular pyramid shape as such, but in rows of equal length subdivided into space units in size progressively larger and number progressively fewer from the bottom up to a top row of one. The sequence of rows is a geometric progression 2n with 32 units in the bottom row and subsequent rows of 16, 8, 4, 2, and 1, with an extra top row of 1 for a total of 64 units throughout.

Player game pieces are advanced in turn by a roll of the dice and according to instructions of cards when a player lands of a space unit that is red or green. "Recruitment" of additional players and "split" of the pyramid are some of the instructions on the cards, which in the former case advance the player serially, and in the latter case advance the player up to the first space on the next higher row no matter what his position and no matter whether a row has been filled. Afterwards, movment resumes in serial fashion by roll of the dice. Green cards generally move the player game piece forward and up, red cards move the player game piece backward and down. Nevertheless, such "recruitment" and "splitting" are only implied and arbitrarily so, by drawing a given card. No actual game pieces are recruited onto the board; only the player game pieces move. The actual movement up the pyramid is serial and does not effect a change according to a geometric progression even though the space units are laid out in that manner. There is no room for splitting because there is only one pyramid. Furthermore, more than one player game piece may occupy the same space unit, so that what happens to one game piece does not affect the other except by one getting to the top first and thereby winning. There is also no actual collecting or exchanging of play money in the game. (The use or non-use of play money or chips is not the focus of this application, unless it bears directly on the pyramid scheme process and its geometric progression.)

It may be concluded that in each of the above games the relationship of the game apparatus to a pyramid scheme and/or geometric progression is a static relationship rather than a dynamic one.

SUMMARY OF THE INVENTION

Accordingly, it is an object of the present invention to provide new and improved game equipment which, in its play simulates in a dynamic way the mechanism by which a participant in a pyramid or Ponzi scheme "moves up" through a pyramid progression.

Another object of the present invention is to provide new and improved game equipment by which one or more game pieces are moved on a playing area path in accordance with a process which utilizes a geometric progression in a dynamic way.

Yet another object of the present invention is to provide new and improved game equipment by which one or more game pieces are moved on a playing area path in accordance with a process which utilizes a dynamic relationship between a geometric progression and a saturation point.

Still another object of the present invention is to provide new and improved game equipment by which one or more game pieces are moved over one of various possible playing area configurations in accordance with a "basic Process" including "moving up", "piloting out" and "splitting."

A further object of the present invention is to provide new and improved game equipment by which a game piece or pieces are moved according to the above-mentioned "basic process" and wherein provisions are made through a "secondary process" to simulate an ever-expanding geometric progression using a finite number of game pieces and a limited size playing area.

A still further object of the present invention is to provide new and improved game equipment of the type described above, and wherein the configuration of the playing area can take one of several various formats corresponding to various methods of game play, and the playing area means and its subdivisions may be transformed by various means of "folding".

Briefly, in accordance with the present invention, these and other objects are attained by providing game equipment preferably including a game board or display providing a playing area, a plurality of sets of "network" game pieces, recruitment determining means, and optionally, several player game pieces, play money, sets of instructional cards, and the like.

The game board or display, hereinafter referred to as the "game board" has a playing area defined by a plurality of basic space units arranged in at least one, and sometimes a plurality, of levels. The basic space units in each level are arranged to form a plurality of "pyramid" modules, each module including a number of steps or stages of basic space units to be played upon. The groupings of space units into stages and the groupings of stages into modules, modules into levels, levels into "zones" and so on, is done by position (as in rows), color, shape, numbering, size, sound, pattern or texture, or combinations of the above. The number of basic space units in each row is determined by a geometric progression of a type used in the pyramid or Ponzi schemes described above. The "top" stage of each pyramid module contains the smallest number of basic space units, usually a single space unit although a greater number of space units may be used. The number of space units in the following stages of each pyramid module is a multiple, according to the geometric progression, of the number of space units in the first stage. The terms "pyramid", "pyramid module" and "module" herein refer to pyramid progressions, i.e., groupings of space units and/or the game pieces which occupy them which exhibit the geometric progression independent of module shape, not to be confused with the three-dimensional pyramid shapes which are a class of polyhedrons. The latter will be mentioned under three-dimensional game boards.

Indicia may be provided on the space units and game pieces which relate one or more groups or sub-groups of the pyramid modules to corresponding network and/or player game pieces and other components of the game equipment.

DESCRIPTION OF THE DRAWINGS

A more complete appreciation of the present invention and many of the attendant advantages thereof will be readily understood by reference to the following detailed descriptions when considered in connection with the accompanying drawings in which:

FIG. 1 shows a game board not in accordance with the present invention, but rather with space units arranged according to an arithmetic progression;

FIG. 2 illustrates sets of "network" game pieces for use in playing a game in accordance with the invention;

FIG. 3 illustrates player game pieces for use in playing a game in accordance with the invention;

FIG. 4 illustrates play money used in playing a game in accordance with the invention;

FIG. 5 illustrates a die used in playing a game in accordance with the invention;

FIGS. 32 is a plan view of a one-directional module according to the present invention;

FIG. 33 is a plan view of a two-directional module according t the present invention;

FIG. 34 is a plan view of a four-directional module according to the present invention;

FIG. 35 is a perspective view of a five-directional module according to the present invention;

FIG. 36 is a perspective view of a seven-directional module according to the present invention;

FIGS. 62–66 are plan views of embodiments of playing areas using the modules of FIGS. 61, 58, 58 again, 59 and 60 respectively;

DETAILED DESCRIPTION OF THE DRAWINGS

Figure 6:
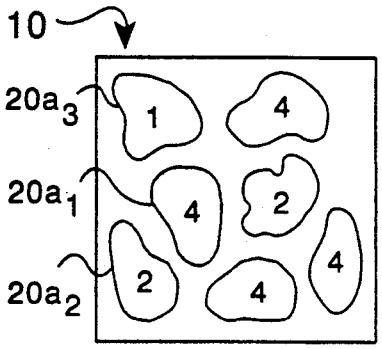
FIGS. 6–11 are each a plan view of one pyramid module of a game board having a playing area according to the present invention, using numbering, shape, position, pattern, and size respectively as indicia that identify the stage groupings of space units.
Figure 7:
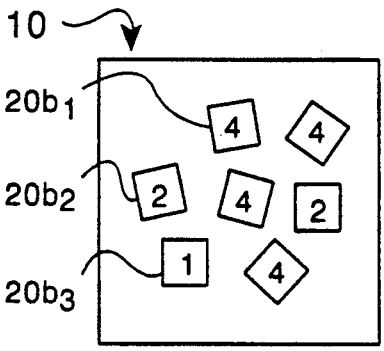
Figure 9:
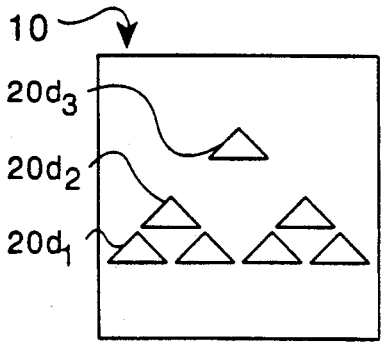
Figure 8:
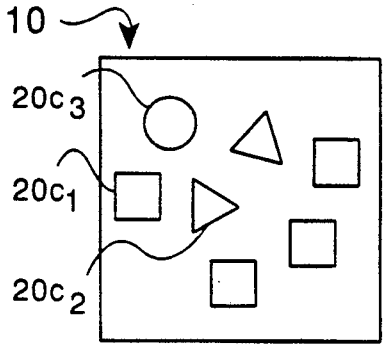
Figure 10:
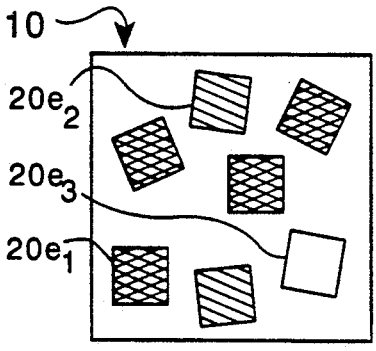
Figure 11:
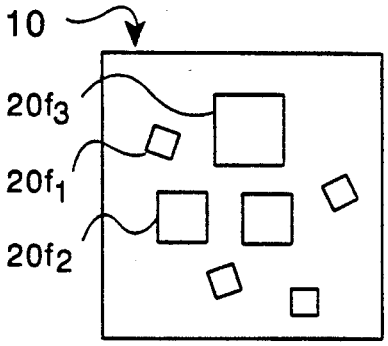

There are numerous problems involved in attempting to contain a geometric progression within a game board format with any degree of regularity and readability, much less to have it function as a dynamic process. After just a few progressions the numbers get much too large to be easily manipulated tin terms of both game pieces and playing area. All of the embodiments of the present invention were designed for use with set of network game pieces 12 to simulate limited populations from which to recruit "passengers" (FIG. 2). The use of the minimum numbers needed to play through the playing area path was found to be the most interesting and practical, and for most of the embodiments chosen those numbers ranged from thirteen to twenty-one network game pieces for each player. Recruitment determining means are usually a die or dice 18 (FIG. 5) or a fixed number of game pieces that a player may bring on the game board each turn. Player game pieces 14 (FIG. 3), and play money 16 (FIG. 4) are used in some embodiments and not in others.

A variety of formats for game boards are playable with the present invention using numbering, shape, position, pattern, texture, color, size, and even sound (on a computer or electronic game board) as indicia identifying the space units, stages, levels of play, and/or "zones" of play, and some of these indicia are illustrated in FIGS. 6–11. "Zones" of play generally refers to the replaying of the entire game board with different or cumulative sets of rules. The space units 20*a* and 20*b* of FIGS. 6 and 7 use numbering indicia to group the space units into stages, the number 4 marking a space unit 20$a_1$ in a stage of play with four space units, the number 2 marking a space unit 20$a_2$ in a stage of play with two space units, and the number 1 marking a space unit 20$a_3$ in a stage with one unit, following a progression of play of four, two, and one. FIGS. 8–11 show the same 4-2-1 progression of space units 20*c*, 20*d*, 20*e*, and 20*f* using shape, position pattern and size indicia respectively.

Figure 12:
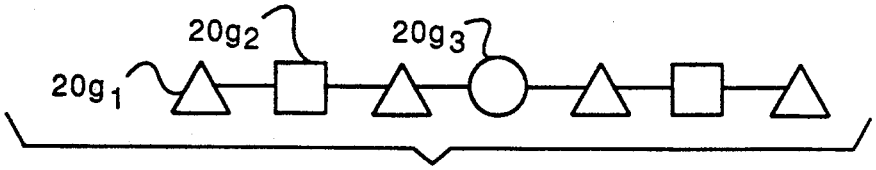
FIG. 12 is a plan view of one pyramid module of a game board according to the present invention in which the space units are lined up in a one-dimensional format.
Figure 13:
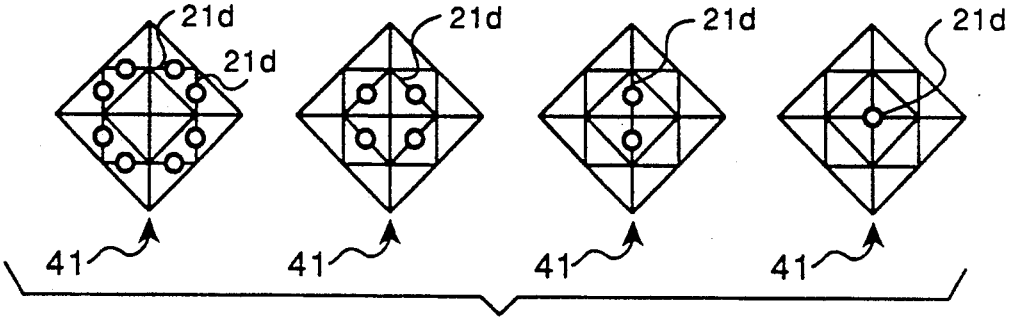
FIG. 13 is a diagramatic illustration showin the sequential positions of space units in each stage of a module of a game in accordance with the present invention, wherein the space units are the lines or vertices between spaces, with the game piece positions represented by dots.
Figure 14:
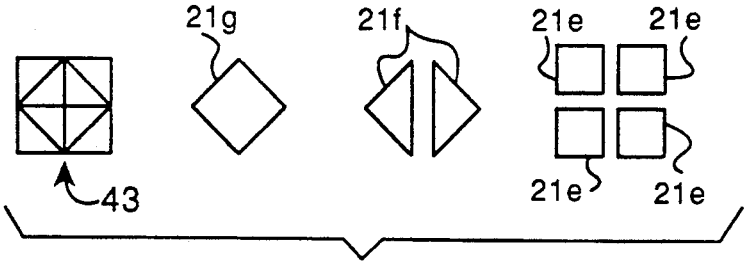
FIG. 14 is a diagramatic illustration of three stages of space units of a module according to the present invention, wherein the space units coincide or overlap in space using shape, size and position indicia.
Figure 15:
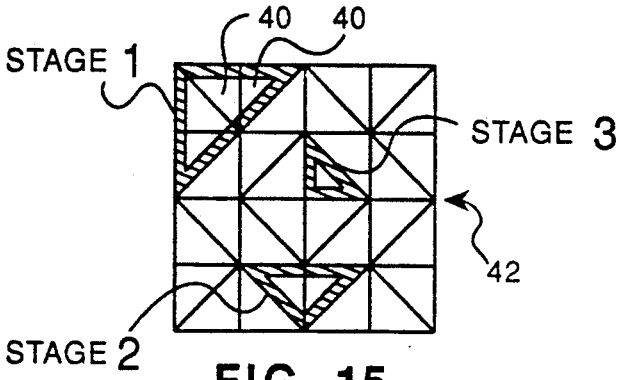
FIG. 15 is a plan view of a game board section according to the present invention, using modules with stages which are entirely separate from each other, one of said module stage sets being represented in bold outline.
Figure 16:
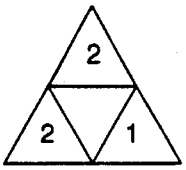
FIGS. 16–19 show plan and perspective views of the simplest, most basic module configurations from which are derived most of the game boards according to the present invention which use a $2^n$ progression.
Figure 17:
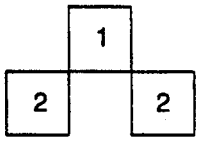
Figure 18:
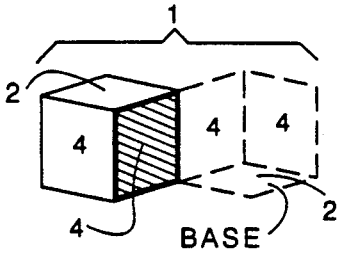
Figure 19:
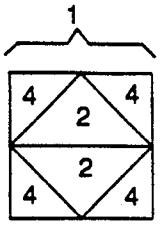
Figure 20:
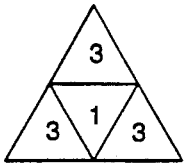
FIGS. 20–23 show plan and perspective views of the simplest, most basic module configurations from which are derived most of the game boards according to the present invention which use a $3^n$ progression.
Figure 21:
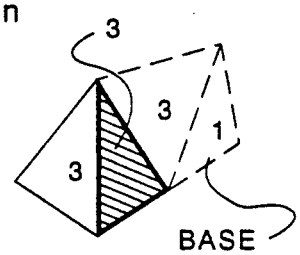
Figure 22:
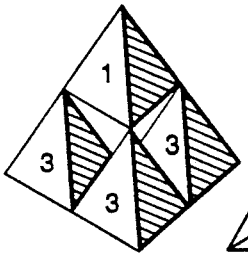
Figure 23:
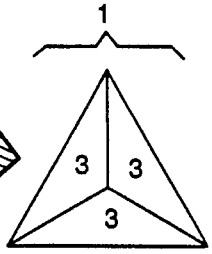
Figure 24:
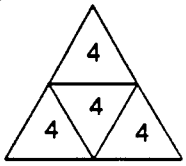
FIGS. 24–31 shown plan and perspective views of the simplest, most basic module configurations from which are derived most of the game boards according to the present invention which use a $4^n$ progression.
Figure 25:
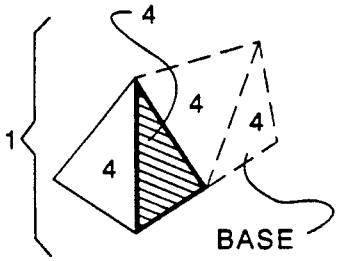
Figure 26:
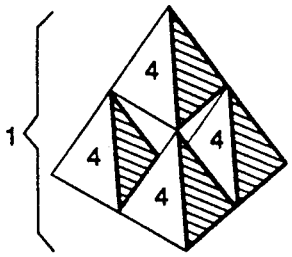

Any of the indicia used in FIGS. 6–11 as well as color and sound (the latter not picutured) could be used in a one-dimensional line format as well, such as in the module pictured in FIG. 12, wherein 20$g_1$, 20$g_2$, and 20$g_3$ triangles, squares and a circle indicate the 4-2-1 progression of space units. The space units may also be the lines or vertices between spaces, as for example FIG. 13 wherein the sequence of stages of one module 41 in play is shown with the game piece positions on the space units 21d represented by dots. Space units and stages may also coincide or overlap in space, as in the FIG. 14 module 43, wherein the larger square 21*g* diagonally positioned represents stage three, two triangles 21*f* represent stage two, and four smaller, upright squares 21*e* represent stage one. The modules of embodiments of the present invention may also have stages positioned entirely separate from each other, as in the game board 42 in FIG. 15, wherein the space units 40 are arranged into stages separated by space units of other modules, one such module shown in bold outline.

Although a variety of formats are possible, a few basic modules were found to be ideally suited as the building blocks for preferred embodiments of the present invention using two, three, and four-dimensional space. Generally, the number of space units in each pyramid stage is determined by a geometric progression in the form $K^n$ where K is a number other than 1, and n is the inverse number of the pyramid stage (starting the progression with the stage with the fewest number of space units) minus 1. These basic modules are pictured in FIGS. 16–31. For purpose of clarity only space units that are actual spaces rather than points or vertices are shown. The stages are indicated again by numbering the space units 4, 2 and 1, corresponding to the number of space units in a given stage rather than the order of play, which begins with the 4's stage. FIGS. 16–19 show the basic modules using $2^n$ progressions; FIGS. 20–23 show the basic modules for $3^n$ progressions, and FIGS. 24–31 show the basic modules for $4^n$ progressions. The dotted line forms indicate projections of sides hidden from view in perspective drawings of opaque three-dimensional modules. By reference to these and the subsequent drawings one can appreciate that the most useful shapes can be repeated in progressively larger sections of the game boards so that the game boards themselves can exhibit the geometric progressions. Game boards comprised of equilateral triangles afford somewhat less readability than squares, but usually the most number of possible players usually, the smallest space requirements for modules, as well as multi-directional capability and multi-directional symmetry.

The number of directions in which a module of the present invention can be played is generally limited not only by the positioning of stages but also the ability to maintain bilateral, radial, or even central symmetry in a given direction. FIG. 32 shows a one-directional and FIG. 33 a two-directional module, both with bilateral symmetry. Compare the pyramid of tetrahedrons in FIG. 22 with the pyramid of cubes in FIG. 31. The tetrahedron pyramid affords less readability, especially when combined as in FIGS. 78 and 79, but affords five directions of play (FIG. 35); while the cubes are more readable but afford only one direction, unless an additional cube is added underneath (FIG. 36) to create seven directional possibilities. In the latter case, for six of the seven direction, one of the cubes is not used, the one positioned most away from the direction of play. For the seventh direction, toward the center of the module, all cubes are used and they can be used for, $2^n$ or $6^n$ progression.

Similarily, in the four-directional module of triangles in FIG. 34 after the direction is chosen, the two space units positioned just under the apex of the triangular module are not used, except when the direction of play is toward the center of the module.

Figure 27:
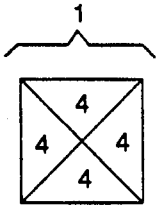
Figure 28:
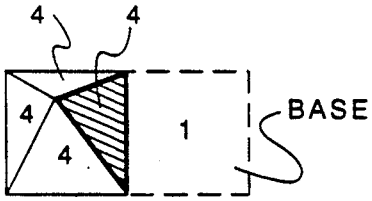
Figure 29:
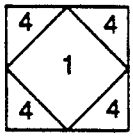
Figure 30:
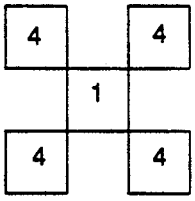
Figure 31:
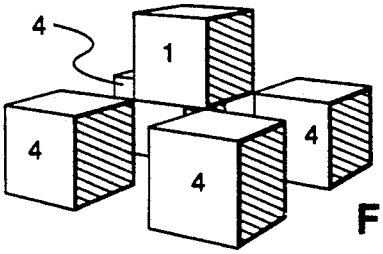

FIG. 28 shows a perspective view of a pyramid based on a square. This figure affords more readability than triangles or squares in three dimensional space because it contains both, but symmetrical direction is limited to one. FIG. 27 can represent either a flat surface or an aerial view of FIG. 28; in similar fashion, FIG. 23 can represent either a flat surface or an aerial view of a three-dimensional pyramid like FIG. 21, which is a tetrahedron, i.e. a pyramid based on a triangle.

Figure 70:
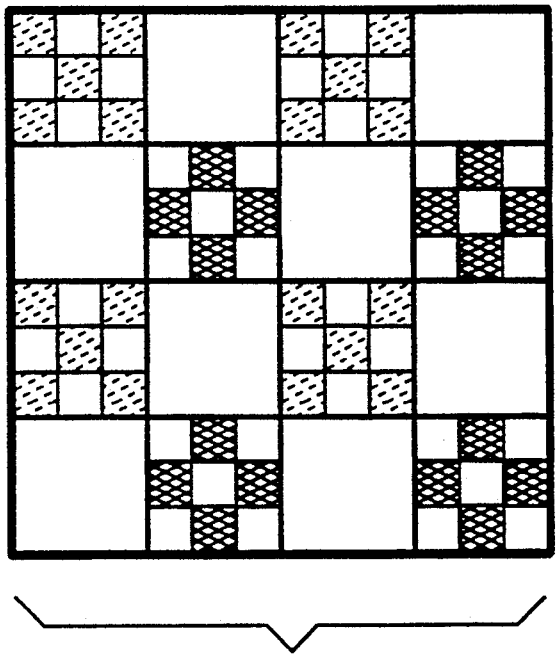
Figure 74:
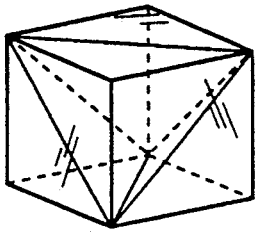
FIG. 74 is a perspective view of a module or game board according to the present invention, which comprises a cube inscribed with a tetrahedron.

Squares as a basic shape for modules according to the present invention are particularly useful on smaller game boards for two to four players (FIGS. 62–66, 70), having multi-directional capability (FIG. 36), being useful as both two and three-dimensional honeycomb playing area means (FIGS. 30, 36, and 70), and for dissecting the cube (FIG. 75), or for inscribing the cube with additional, internal playing area means (FIG. 74). Squares are also useful positioned diagonally to create game boards similar to those created with triangles, and diamonds may also be used (parallelograms with all four sides equal). See FIGS. 60, 61, 62.

Figure 45:
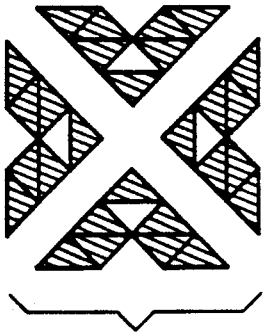
Figure 44:
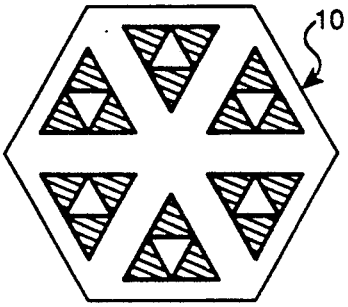
Figure 43:
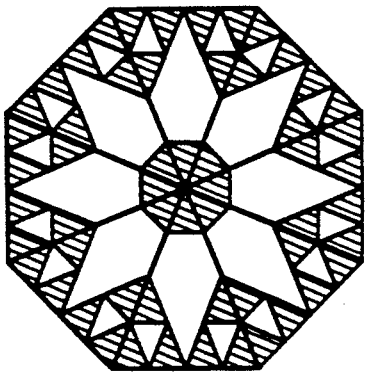
Figure 46:
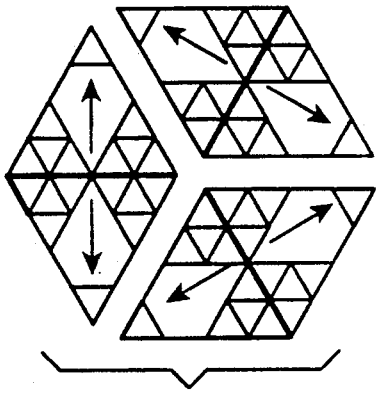
Figure 62:
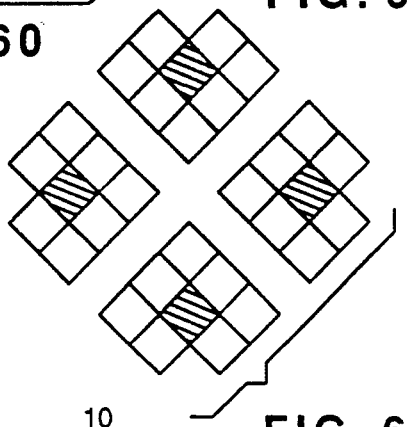
Figure 63:
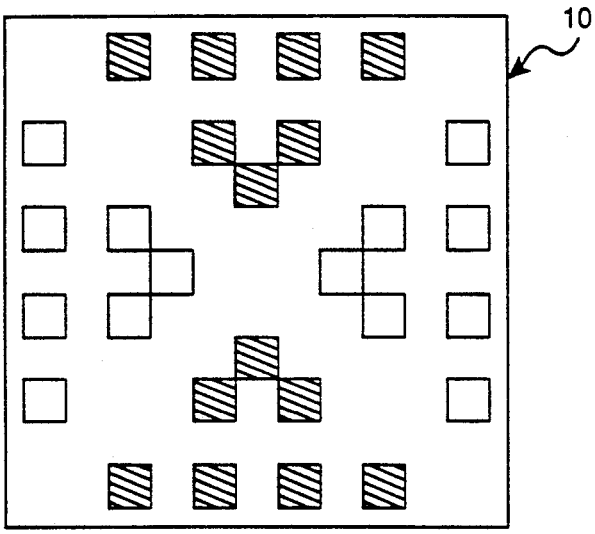

Separating the larger sections of some of the game boards into separate boards facilitates multi-directional play just by rotation (FIGS. 45, 46, 62).

Figure 55:
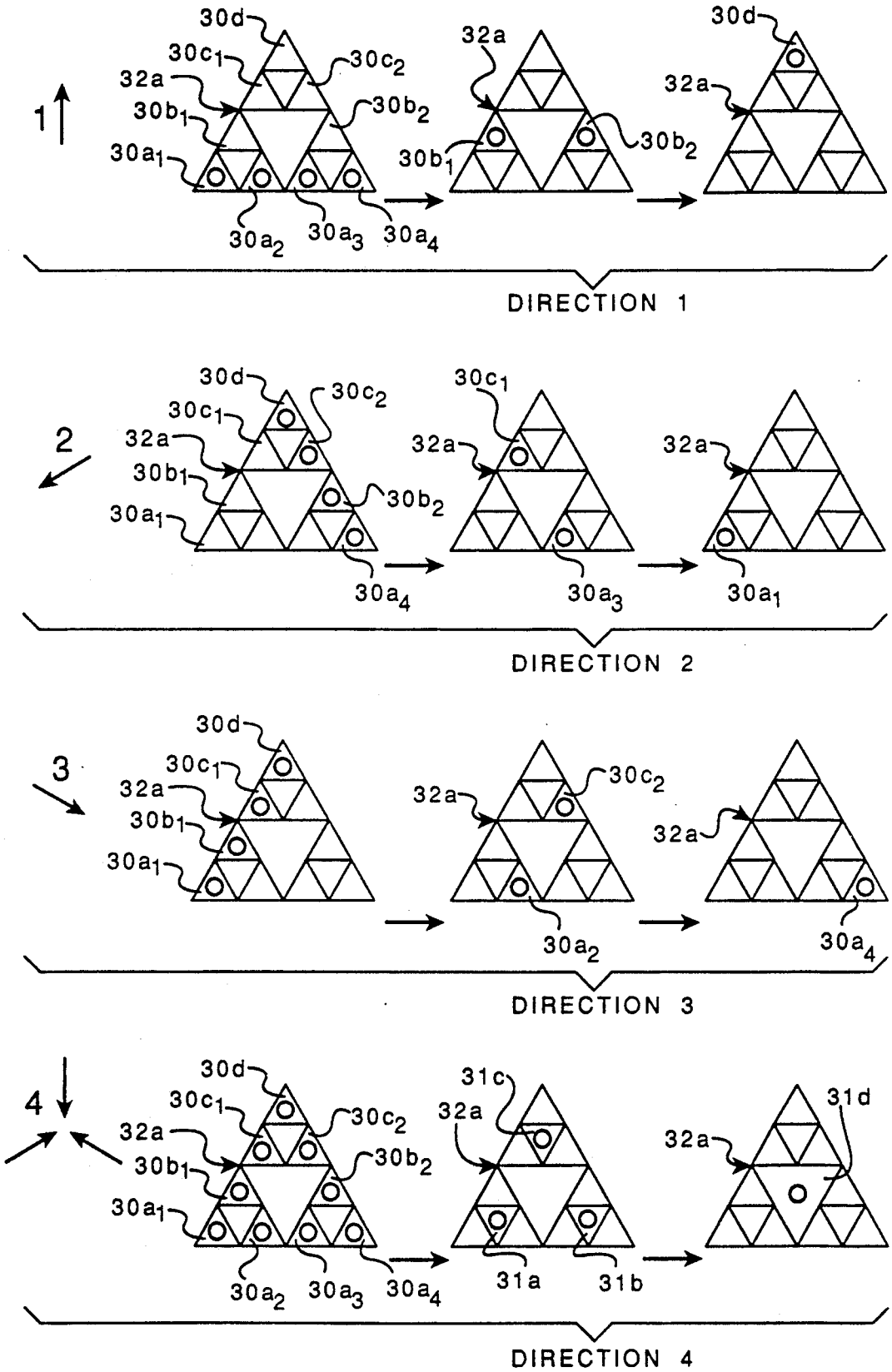
FIG. 55 is a diagramatic illustration showing the sequence of steps in the play of a game using the game board of FIG. 49, each of the four directions shown separately.
Figure 56:
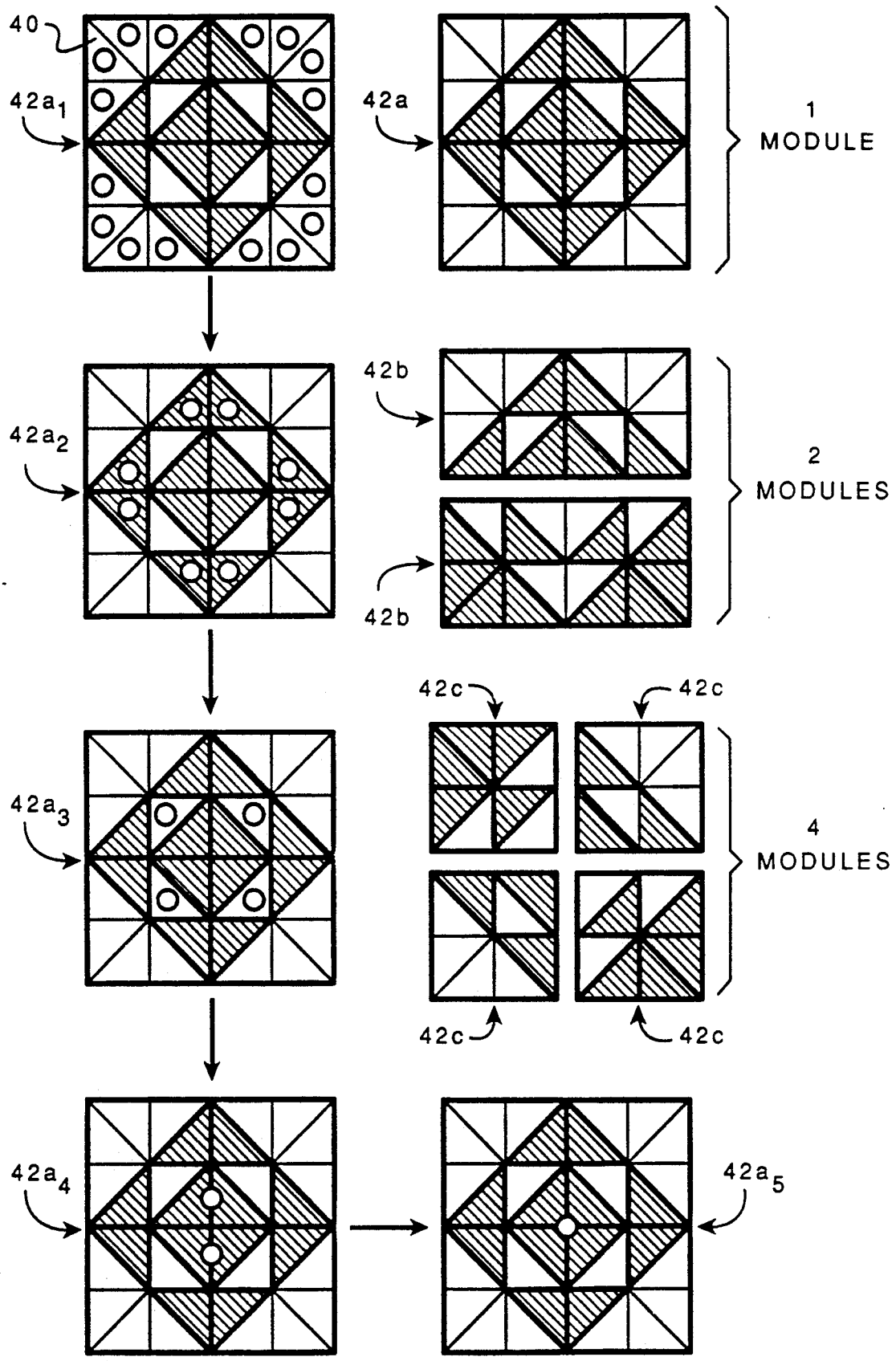
FIG. 56 shows both a diagramatic illustration of the sequence of steps in the play of a game board module using the game board of FIG. 50, and the optional division of that module into two or more smaller modules.

It was found mott expedient to limit the size of the geometric progression to two or three multiples of K where K=2; hence, stages having 1,2,4, and possibly 8 space units. A module with five stages of 16, 8, 4, 2 and 1 space unit respectively is shown in FIG. 56, but the stage of 16 is actually four groups of four space units each, and the module has the option to be subdivided accordingly into two or four separate modules. Where K=3, only one multiple beyond three was practical, hence stages of 1,3, and 9 space units (FIGS. 78,79 and sequence 4 or FIG. 55); or simply 1 and 3 (FIGS. 20, 21, 22, 23, and 71). Where K=4, two stages with 1 and 4 space units respectively were the most practical, a third stage multiple of 16 being a bit cumbersome. FIG. 56 modules can be used for $4^n$ progression by skipping every other stage. The above references can generally be applied to two, three, and even four-dimensional space. In four-dimensional "hyper-space" representations in particular, the simplest regular polygons combined into "hyper-solids" or polytopes are the most readable. FIG. 81$d^4$ shows a "hyper-cube" (measure polytope) with all edges of equal length, that may be used as a module particularly for games in a computer screen format, where the component parts (FIGS. 81, 82, 83) may be readily separated out and recombined or lit up in differentiating colors at different states of game play. In three and four dimensional modules, the space units played are the faces, line edges, or vertices, or entire polyhedrons or combinations thereof (FIGS. 81–83, 80, 73–77, 31,28 25,21,18).

In the first illustrated preferred embodiment of the invention, the game equipment comprises a game board, generally designated 10 (FIG. 37), six player game pieces 14 (FIG. 3), six sets of network game pieces 12*a*, 12*b*, . . . 12*f* (FIG. 2), play money called "feathers" 16

(FIG. 4), and recruitment determining means in the form of a die 18 (FIG. 5).

The game board 10 of the illustrated embodiment has a playing area 11 in the shape of a hexagon in which a plurality of basic space units 20 are arranged to form a plurality of pyramid progressions (modules) 22*a*, 22*b* which are themselves arranged in two levels around a central region 24 of the playing area 11. Although the space units 20 are triangles, it is understood that any shape may be utilized, such as circles, squares, stars, etc., so long as the space units are arranged or identified in "pyramid" form according to a geometric progression as described below.

Figure 38:
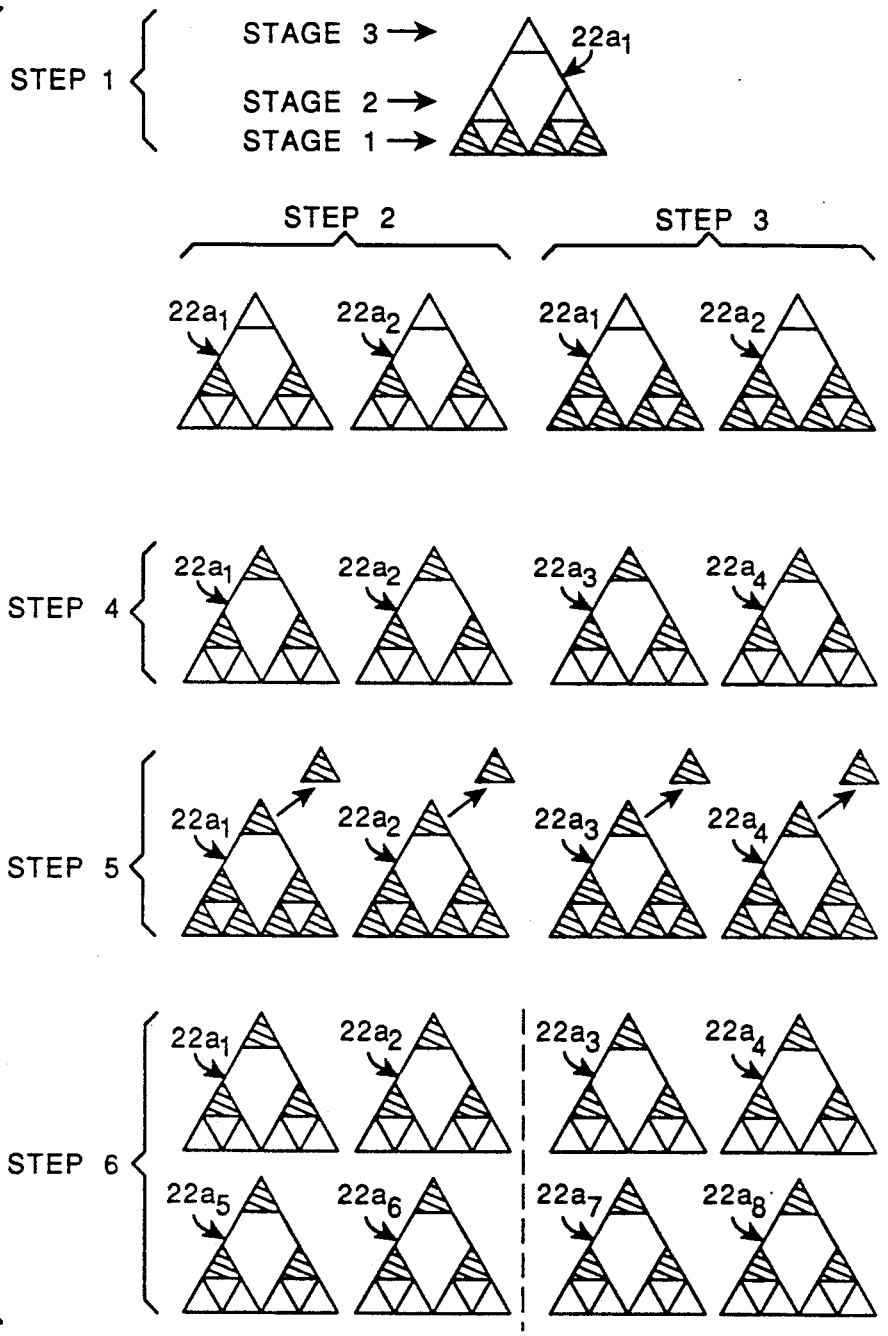
FIG. 38 is a diagramatic illustration showing a sequence of steps in the play of a game using modules of the game board of FIG. 37.

Referring to FIG. 38, each pyramid module 22 includes seven space units 20 arranged in three stages "a", "b" and "c". Play generally begins on the "bottom" stage, i.e., the stage with the most number of space units, and game pieces can only come on the board at that stage. The last or "top" stage 3 comprises a single space unit 20, the next or middle stage 2 includes two space units 20, and the first or "bottom" stage 1 includes four space units 20.

Figure 40:
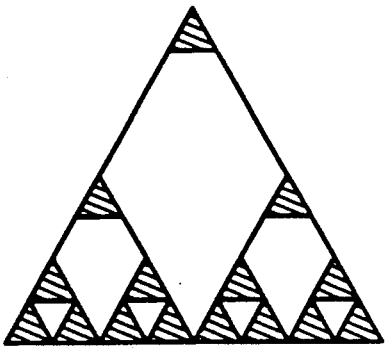
FIGS. 40–48 are plan views of other embodiments of playing areas in accordance with the invention.
Figure 41:
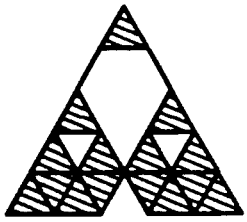
Figure 42:
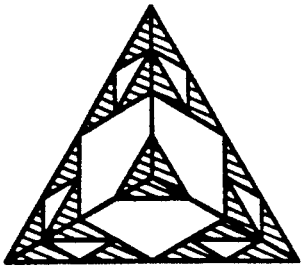

In this first preferred embodiment (FIG. 37), a $2^n$ progression is used, wherein $K=2$ so that the first three numbers of the progression are 1,2,4 for the corresponding first, second, and third stages respectively. If the pyramid module included a fourth stage, it would contain $2^3$ or eight space units (FIGS. 40 and 41). If the top stage were to contain more than one space unit, the first number in the progression would be dropped.

Figure 37:
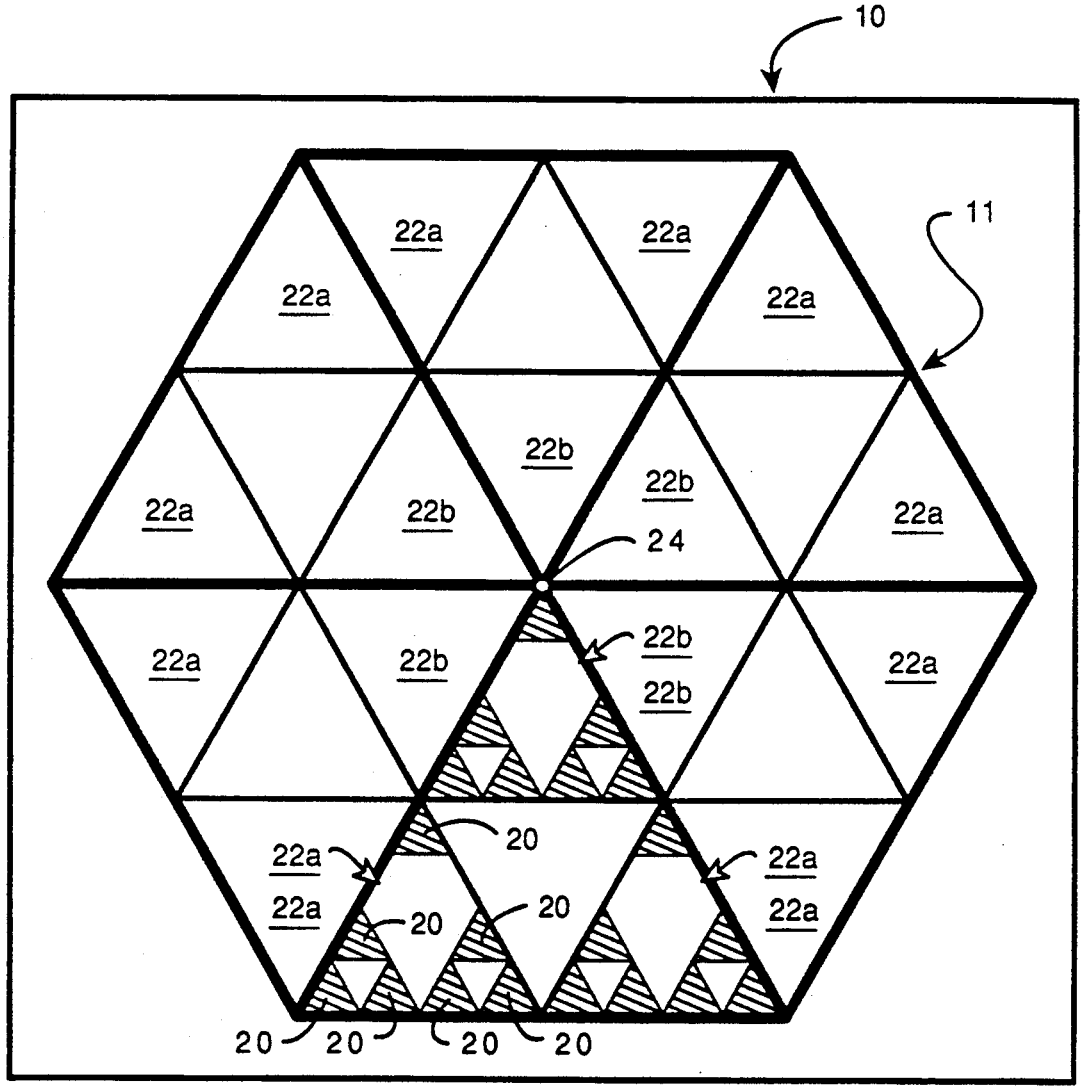
FIGS. 37, 49, 50, 65, 69, and 70 are plan views of preferred types of embodiments in the detailed descriptions which follow.

Referring to FIG. 37, twelve modules 22*a* bound the outer periphery of the playing area 11, the bases of pairs of adjacent modules forming a straight line constituting one side of a hexagon. These outer twelve triangular modules 22*a* are designated first level modules 22*a*. Each pair of first level modules 22*a* is aligned with a respective inner module 22*b* to form a triangular group of three modules constituting a one-sixth section of the area encompassed by the outer hexagon. The basis of the six inner modules 22*b* form the sides of an inner hexagon. The inner modules 22*b* are designated second level modules 22*b*. Each inner module 22*b* also is defined by three stages (rows) of space units 20, including one, two and four space units respectively.

All of the space units 20 within each one-sixth section of the area within an outer hexagon defined by two first level modules 22*a* and an aligned second level module 22*b* are optionally provided with the same identifying indicia, such as the same color, so that a total of six colors appear on playing area 11. It is understood that the use of indicia here to section off sets of space units on the game board in accordance with sets of game pieces of players is optional according to the present invention, but that said use of said color indicia contributes significant new structures to the "basic process" played out on the game board in a dynamic way. For example, the use of said color indicia creates a smaller population of game pieces to reach saturation point, while at other times, the non-use of said indicia creates a larger population, i.e., all six player networks, to play up and around the entire game board unimpeded by adjacent color boundaries, but still to interact with a saturation point which comes later. Without color boundaries, the playing area path is part vertical or central, part spiraling in both directions simultaneously, from periphery to center and back again, in a double helix pattern. The use of color boundaries, however, affords the use of fewer game pieces needed to move from one level to the next, in accordance with both the "basic process" and the "secondary process" described below.

Play of the game can be according to any suitable set of rules by which the player and/or network game pieces 14, 12 move on paths defined by the space units 20 in a manner which simulates the mechanism by which a participant in a pyramid scheme "moves upwardly" through a pyramid module in accordance with a "basic process" which includes the steps of "recruiting," "splitting," "moving up" and "piloting out."

In the illustrated embodiment, the game pieces move on the playing area 11, both circumferencially or laterally and in a direction towards center region 24, and then optionally, from the central region outward toward the peripheral border 11, although these directions are not essential as described below. The play of the game will be described according to one possible set of rules which simulate the Airplane Game pyramid scheme described above although it is understood that the game can be played in accordance with other rules. Each module 22*a* and 22*b* will hereinafter be referred to as an "airplane" or "rocket" or generically as a "vehicle." Each of the seven space units 20 of each vehicle will hereinafter be referred to as a "seat" on the vehicle. The inner, second level of vehicles is called the "pilot's game." When the entire board is replayed in subsequent rounds with progressive sets of rules, each round is referred to as a "flight zone" or "zone."

As noted above, the game equipment also includes six player game pieces 14 (FIG. 3) with indicia optionally corresponding to identifying indicia on the playing area 11 and six sets of pawns or triangular network game pieces 12 (FIG. 2) representing each player's "network," i.e., the "universe" of "persons" available to the player for recruitment as "passengers" for a flight vehicle. The network game pieces 12 of each set are also provided with indicia corresponding to the identifying indicia on the playing area 11 and player game pieces 14. A die 18 (FIG. 5) and optional play money referred to as "feathers" 16 (FIG. 4) complete the game equipment in the illustrated embodiment.

At the start of the game, each player is given the same amount of "feathers" play money. The die 18 is rolled by a player. The number rolled represents the number of Passengers that the player can "recruit" for an airplane 22*a*. The player's player game piece 14 represents the player while the network game pieces 12 of a corresponding set represent the player's network, i.e., the Passengers which can be recruited by the player. The player game piece 14 is played first. For example, if the number rolled on the die is two, the player places his player game piece 14 and one network game piece 12 on respective ones of two Passenger seats 20 (i.e. the space units 20 in the bottom row "c") of one of the airplanes 22*a*. Since upward movement within the playing path is not serial but by geometric progression, the choice of which seat to play on is not serial but according to which side of the airplane the player wishes to move up with. Strategy unfolds accordingly. The next player then rolls the die and similarly recruits passengers for, in this particular embodiment of the game at its beginning, the same airplane. When the Passenger seats 20, i.e., the space units 20 of the bottom row of an airplane, are full, the airplane "splits" laterally, i.e., within the same level, and the Passengers move up to the Crew seats 20 (i.e., the space units 20 in the second row "b") on that airplane and an adjacent airplane. When the Passenger seats on these two airplanes have been filled, the airplanes again split with the Passengers and Crew moving up to the Crew and Pilot seats respectively.

When all of seats on an airplane in the first level of play are full, the pilot "pilots out" while the rest of the plane continues to split and move up. When a Pilot "pilots out" of an airplaee in the first, peripheral level of the game board, that Pilot may then play on the second, central level of airplanes called the "pilot's game." Play in the second level is the same as in the first level, beginning at the passenger row and moving up to pilot, except when a Pilot pilots out of the Pilot's Game, he wins the game or that "flight zone," after which the board is cleared and the two levels are used in the second and subsequent flight zones with different or expanded rules. For example, the type of vehicle in a subsequent zone changes from "airplane" to "rocket" and other types of vehicles, each with different arrangements of space units or seats of increasing monatary value and sometimes a different geometric progression of seats. Other game variables are optionally introduced with sets of instructional cards and the general rules are also designed to give the players a repeated choice to play to win or play to continueplaying with consequent risks, limits, and rewards. Flight zones begin either at the periphery or at the center of the game board.

Seats on a vehicle require payments of money 16 being made by the player recruiting the Passengers to the Pilot of the vehicle to which the Passengers have been recruited or to a "Community Fund" at the start of the game when the vehicles do not yet have Pilots. Also, Pilots are paid out of the community Fund if they recruit their own networks while in the pilot seat, or while one of their own network is Pilot. In addition, alternate rules have been created for play without play money and without dice, using in the latter case a fixed odd number for recruitment each turn.

The object of this embodiment of the game is for a player to be the first to have his player game piece 14 "pilot out" from the highest level vehicle and/or the play as many flight zones as possible before the game ends.

Referring to FIG. 38, the sequence of recruiting, splitting and moving up of the "basic process" can be seen. In step "1", four Passengers have been recruited for airplane $22a_1$ to fill all of the Passenger seats. Airplane $22a_1$ "splits" (step "2") with half of the Passengers moving up to Crew seats in airplane $22a_2$. After all of the passenger seats on each airplane $22a_1$ and $22a_2$ have been filled (step "3"), these airplanes "split" into four airplanes $22a_1$, $22a_2$, $22a_3$ and $22a_4$ with the Crew moving up to Pilot seats and the Passengers moving up to Crew seats (step "4"). When sixteen new Passengers have been recruited (step "5"), the four airplanes are filled and the Pilot of each "pilots out" (leaves the playing area) whereupon the four airplanes split into eight airplanes $22a_1$. . . $22a_8$ with the Crew and Passengers moving up to Pilot and Crew seats (step "6"). The airplanes described above are described as if moving in unison with filling of all passenger seats a requirement before all airplanes split, when actually each airplane moves individually, such that the filling of passenger seats on one given airplane is the only requirement for splitting and moving up. As each of the twelve airplanes (steps "5" and "6") are filled, the "split" results in making a pilot eligible for the airplanes 22b of the second level.

Figure 39:
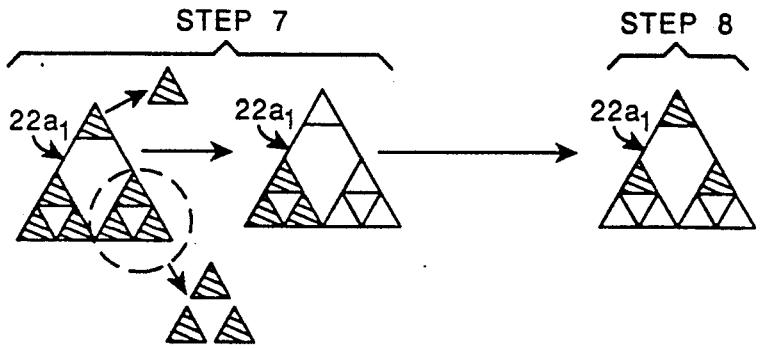
FIG. 39 is a diagramatic illustration showing the sequence of steps in the "secondary process" which follows the saturation point in the sequence of steps in FIG. 38.

Returning to the airplanes in the first level (FIG. 37), when all of the available airplanes on that level are at least partially occupied, splitting in the usual manner of the "basic process" can no longer occur. The approach of the saturation point has thus been simulated. Play continues however, by means of a "secondary process" (FIG. 39) by which one of the two sides of each full airplane is removed from the board and returned to the player's pile of unused network game pieces, which are thus re-usable. Which side comes off and which side stays on is determined by a roll of the dice or by one side being designated as always coming off in these situations. The re-using of game pieces simulates both the finding of new players and the re-recruiting again of players whose airplanes are no longer flying. The removal of one side of the airplane in the "secondary process" split represents a three fold simulation: The players (game pieces) removed (1) go on to play on an airplane not shown that is at a standstill because it cannot recruit more passengers, or (2) they are playing elsewhere outside the networks of this game, or (3) they have stopped playing. Meanwhile, the other half of the airplane moves up on that airplane as usual. The rules of play are such that either the right side or the left side always comes off the board, or the decision is made by a roll of the die. Thereafter, each time a bottom row of four passenger seats is filled, three game pieces are returned to the re-usable pile, one from a crew position and two from passenger positions on the same side, for a net of one less in the re-usable pile and one more on the game board, such that the number of playable game pieces is gradually reduced to zero, but each piece being used many times so as to simulate a much larger universe of available participants. It may be helpful to note that the gradual diminishing of available game pieces is a function of each pilot staying on the game board, i.e., moving up to the second level. If each pilot that piloted out were returned to the re-usable pile with others, there would be no net gain or loss and the game could indeed theoretically go on forever, recycling the same pawns (FIG. 39). However, this would mean no net gain in money for any passenger who becomes Pilot. To realize a profit either the Pilot must "pilot out" and stay out, or new passengers must continue to enter the game with additional money.

It is understood that other embodiments of game equipment in accordance with the invention are possible so long as movement of the game pieces follows the "basic process" described above, i.e., laterally and in a certain non-lateral direction. The modules may have more than three stages as previously mentioned (FIGS. 40, 41) and they may also have only two stages as in FIGS. 16, 17, 20–31, and 44). When triangular space units are used, they need not be equilateral; there can be more or less than six pyramids surrounding the central area, in which cases the playing area will be polygonal having a number of sides corresponding to the number of the largest pyramids, and the base of each pyramid becomes shorter and the sides of the pyramid become relatively longer, or vice versa (FIGS. 42, 43, 45 & 50). Theoretically, there is no limit to the number of pyramids and when the game equipment is applied, for example, to a computer screen format, the number of pyramids can be significantly greater than in the case where the invention is applied to a game board.

It is also not essential that the sides of the pyramid modules be coincident with each other. Spaces may be provided between the pyramids which would not affect the movement of game pieces except to add the possibility of rotation, as in FIGS. 45 and 46 for example.

Figure 47:
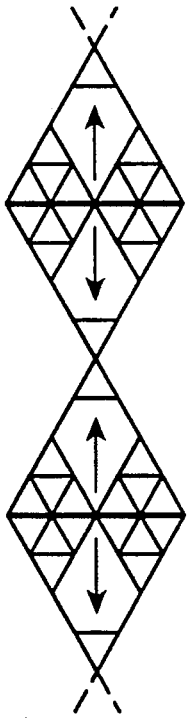
Figure 48:
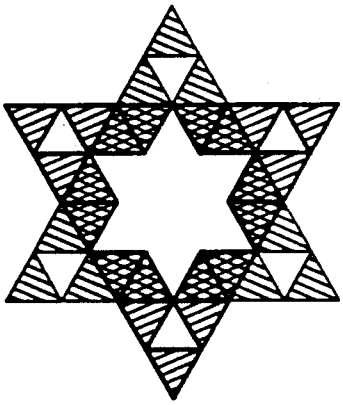
Figure 50:
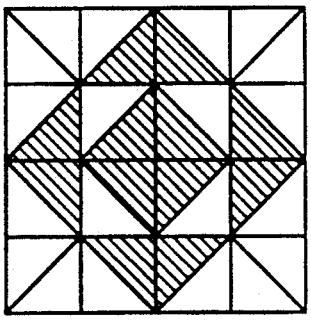

In most of the embodiments described above, whether built with or derived from basic modules using squares or triangles (FIGS. 16–31) or with other shapes not here illustrated, the overall movement of the game pieces is usually lateral and inward towards the center of the playing area. However, this is not essential either. In keeping with the "basic process" of the game, the direction of game piece movement which is common to most if not all embodiments of the invention in which position is a significant indicia, is lateral and "vertical," i.e., towards the "top" of any respective module, whichever direction that module may be pointing; or towards the center of that module itself. The modules may be arranged base to base and/or apex to apex as in FIG. 47. The modules might also be arranged in one or more rows, as in FIGS. 38 and 85 and the rows could be straight, curved, zig-zig, spiral, or any other line configuration without affecting the play of a given module. The modules may also be arranged in rows of progressive width that fan out and then optionally recede in width so that the arrangement of modules is similar to the arrangement of space units and single modules in FIG. 47. An example of a game board in which the direction of play is lateral, i.e., at right angles to the central region, is FIG. 46. The modules may also face away from the central region, as in FIG. 48. In addition, the modules may be arranged into a honeycomb configuration, whether in two or three-dimensional formats, as in FIGS. 36, 56, 70 and 79.

Some embodiments of the invention as described above, may be fitted into a more compact game board, either smaller as a whole or the same size but with more stages added, by the use of a third significant process of the present invention called a "folding process." (See FIGS. 51, 52, 53 and 54.) The folding process may be used for the bottom stage of a module in game embodiments in which the shapes and positions of the space units are the indicia determining the stages of the modules, and wherein equal sized and shaped space units 23, 24, and 30, as well as the stages 25*a*, 25*b*, 25*c*, and modules 25*d*, 28*d*, and 32*a*, 32*b* . . . etc. are spaced uniformly such that the modules may each be bounded by an actual or implied isosceles triangle or an arrangement of such proportionally skewed; and except for the "folded" bottom row, all space units are equidistant from adjacent space units above, beside, and below them within a given module. As a result, bilateral symmetry of the module is apparent and this is retained when using "folding", in relation to the module as a whole, although not between all stages after "folding" occurs. Without "folding", the addition of a single new row would necessitate a very large increase in the size of the module to maintain the symmetry. (Compare FIGS. 40 and 41).

Figure 51:
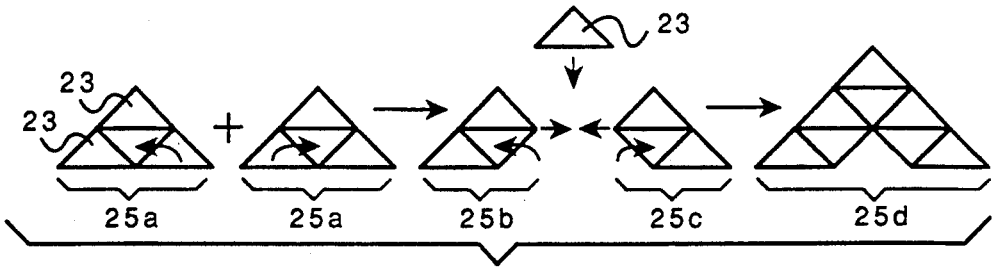
FIGS. 51 and 52 are diagramatic illustrations showing the sequence of steps in the basic "folding process" for triangles and squares for use both in creating fixed modules on game boards and in rearranging module configurations on game boards wherein such modules are changeable.
Figure 52:
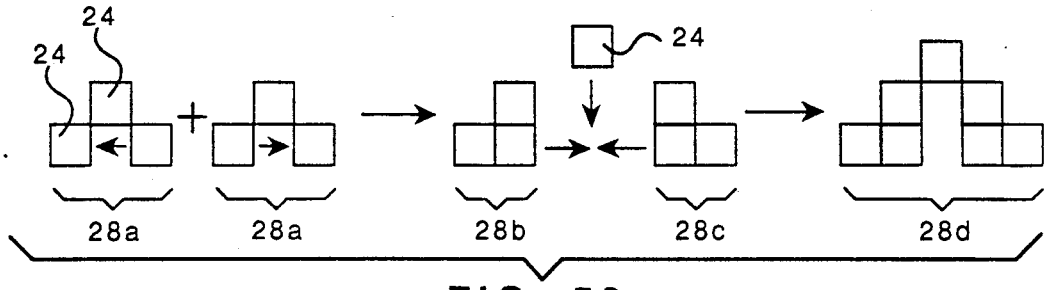

In game embodiments whose game boards follow the geometric progression $2^n$, as in the first preferred embodiment, twice as many space units may be fitted into available space for the third row or whichever subsequent row is designated the bottom row, by "folding." "Folding" is so named as it was derived from an initial discovery that the inner two space units of the bottom rows of two adjacent two-row modules (one from each) could be folded, each inward toward the other space unit of its module on the same row, (for triangular space units the folded unit takes an inverted position) following which the two modules could be pushed together and a new top row of one space unit added above, resulting in a three-row module that otherwise would necessitate an actual four-row spacing to preserve both bilateral symmetry and the triangular configuration of the module FIGS. 51 and 52).

In the case of "folding" squares in the above situation, the squares actually slide or flip laterally (FIG. 52). Modules made up of square space units exhibit bilateral symmetry and a configuration of stair-steps in a "pyramid" that can be bounded by an implied isosceles right triangle. Applying the initial "folding" discovery in the simplest case to any desired bottom row in the above embodiments of the game whose total number of n space units used in the bottom row is an even number, and where K is an a multiple of 2, the location of the bottom row can be determined by the formula $$h = \frac{K^n + 2}{2}$$

is h height of the pyramid module measured in units of one row height.

Figure 54:
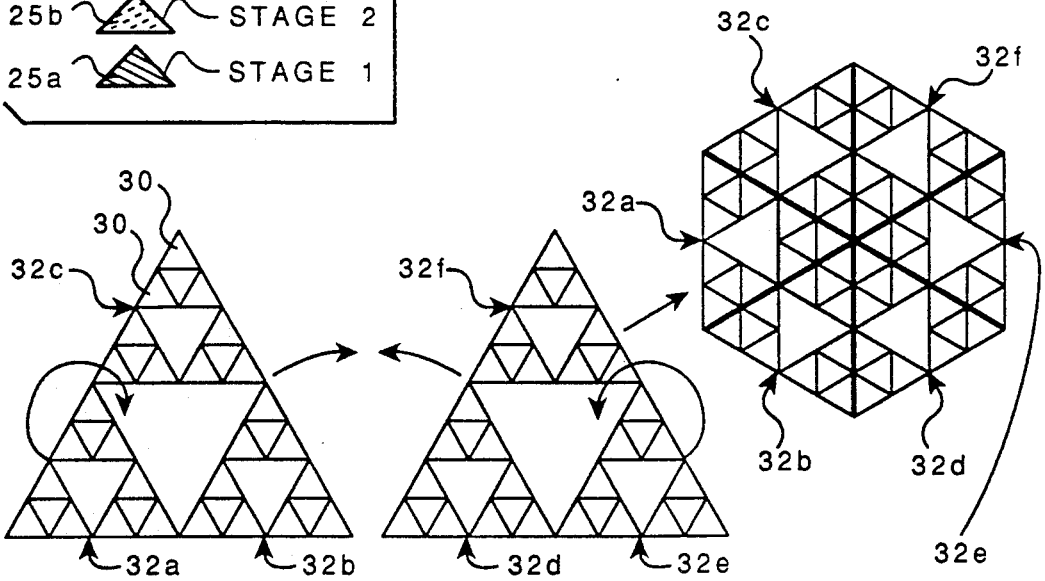
FIG. 54 is a diagramatic illustration showing the sequence of steps in "folding" entire modules to change two triangular game board sections into a hexagonal game board.

Entire modules may also be "folded", as in transforming the triangular game board sections comprised of 32*a*–32*f* modules into a hexagonal game board in FIG. 54.

Figure 49:
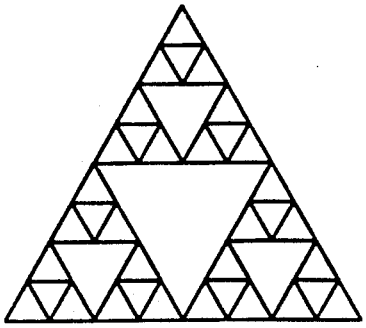

The second preferred embodiment of the present invention is formed by adding a row of two space units in between the middle and last stages to create a multi-directional module (FIGS. 49 & 54). Once the direction of play is chosen, the space unit at the "top" or apex of that direction becomes the third stage of the module. FIG. 55 shows a diagramatic illustration of the sequence of stages to be played in each of three directions according to the above, and a fourth sequence when the direction is toward the center of the module. The former exhibit $2^n$ progressions and the latter a $3^n$ progression. The space units in the row beginning with space unit 30*a* form the first stage in sequence 1, and those units in 30*b* row form stage 2, and 30*d* stage 3, with the 30*c* row not used. In sequence 2, one each of 30*d*, 30*c*, 30*b* and 30*a* form stage one, and the same occurs in sequence 3 from another side. In sequence 4, all of the above space units are used for stage one, and the space 31*a*, 31*b*, 31*c* in the center of each group of three units is used for stage 2, the third stage being the center 31*d* of the module.

The third preferred embodiment of the present invention (FIG. 50) is shown in FIG. 56 as one of several possible sequences of stages of play, in which the stages of the module 42*a* contain 16 space units in stage 1 (42$a_1$), eight space units in stage 2 (42$a_2$ ), four space units in stage 3 (42$a_3$), two space units in stage 4 (42$a_4$), and one space unit in stage 5 (42$a_5$) The optional division of the 42*a* module or game board into two modules (42*b*) and four modules (42*c*) are also shown. The outer space units 40 of stage 1 may also be arranged in the configuration shown in 26*c* of FIG. 53 to form a similar 42*c* module or section of a module. The FIG. 50 module excluding its outer stage may be viewed as either a flat surface or an aerial view of a three-dimensional pyramid based on a square.

Figure 57:
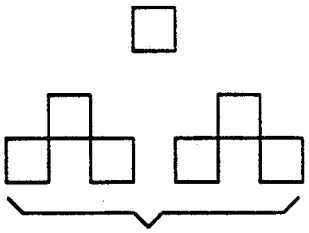
FIG. 57 is a plan view of a 3-stage "unfolded" module constructed from the basic modules 28*a* shown in FIG. 52.
Figure 60:
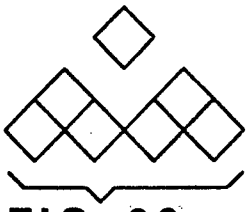
FIG. 60 is an "unfolded" 3-stage module using diagonallypositioned square space units.
Figure 61:
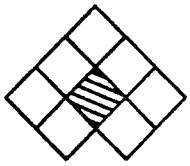
FIG. 61 is a plan view of a "folded" 3-stage module derived from the "unfolded" module of FIG. 60.
Figure 58:
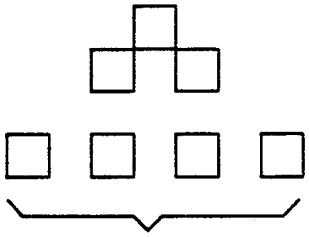
FIG. 58 is a plan view of a partially "folded" 3-stage module derived from the module of FIG. 57.
Figure 59:
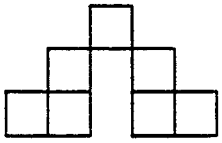
FIG. 59 is a plan view of a "folded" 3-stage module derived from the "unfolded" module of FIG. 57.
Figure 67:
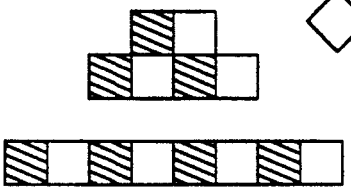
FIG. 67 is a plan view showing how two modules as in the FIG. 63 game board may be overlapped to construct the game board of FIG. 64.
Figure 66:
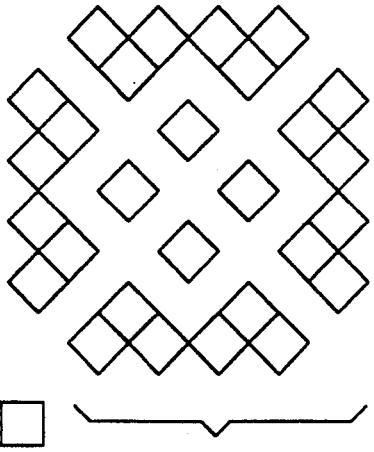

FIGS. 57–67, as indicated in the detailed descriptions of the drawings, show plan views of various unfolded, partially folded, and folded module game boards using squares for space units, positioned either upright as in FIG. 57 or diagonally as in FIG. 60. As previously stated, FIG. 67 shows how two modules from game board 63 may be overlapped to form the checkerboard game board pattern of FIG. 64.

Figure 65:
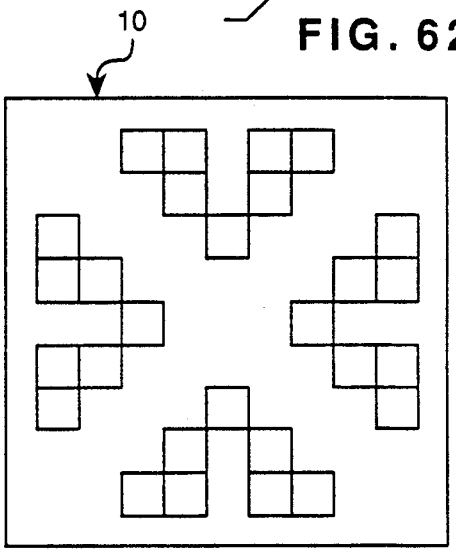
Figure 64:
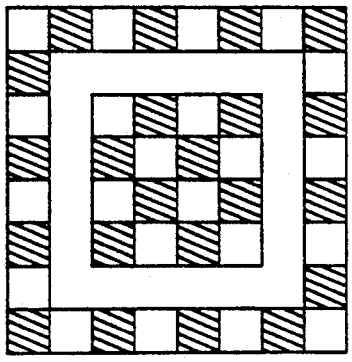
Figure 68:
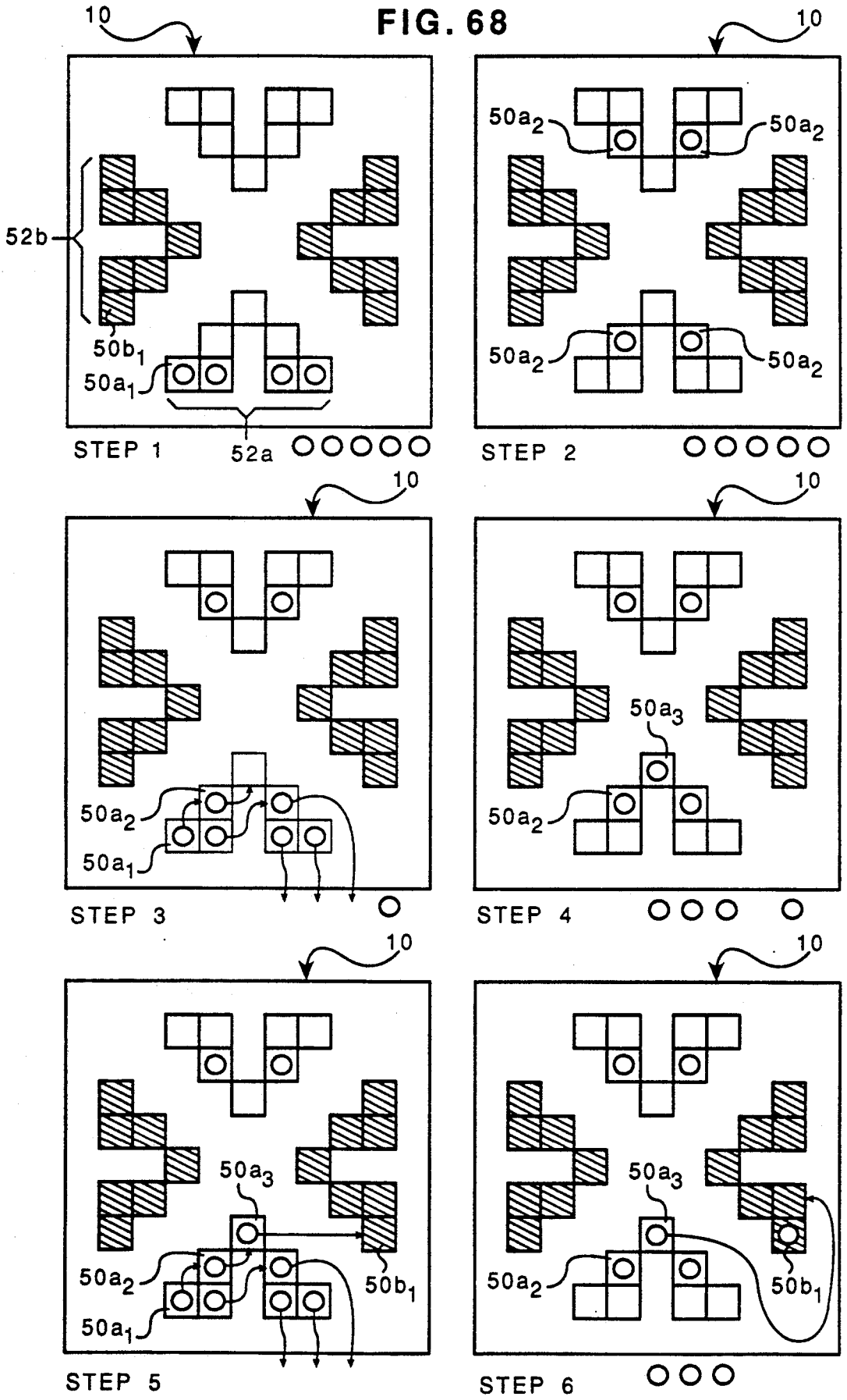
FIG. 68 is a diagramatic illustration showing the sequence of steps in the play of game using the game board of FIG. 65.

In the fourth preferred embodiment of the invention, FIG. 65, the second level of play is actually the modules of the opponent. Player 1 uses the modules in white 52*a* and space units 50*a*, while the opposing player uses the shaded modules 52*b* and space units 50*b*, as shown in FIG. 68. FIG. 68 shows the sequence of steps in the play of a game according to the present invention, using the game board of FIG. 65. The object of the game is to be the first to "pilot out" of either one of the opponent's two modules. Play money is not generally used, and recruitment from the network game pieces is either by a fixed number each turn or by roll or a di. Player game pieces are not used, although additional rules could be devised to accomodate their use. The play of the modules is identical to play of the modules of the game board 37, as shown in sequence in FIGS. 38 and 39. Since there are only two modules per player in game board FIG. 65, the "secondary process" starts after the first split.

Figure 69:
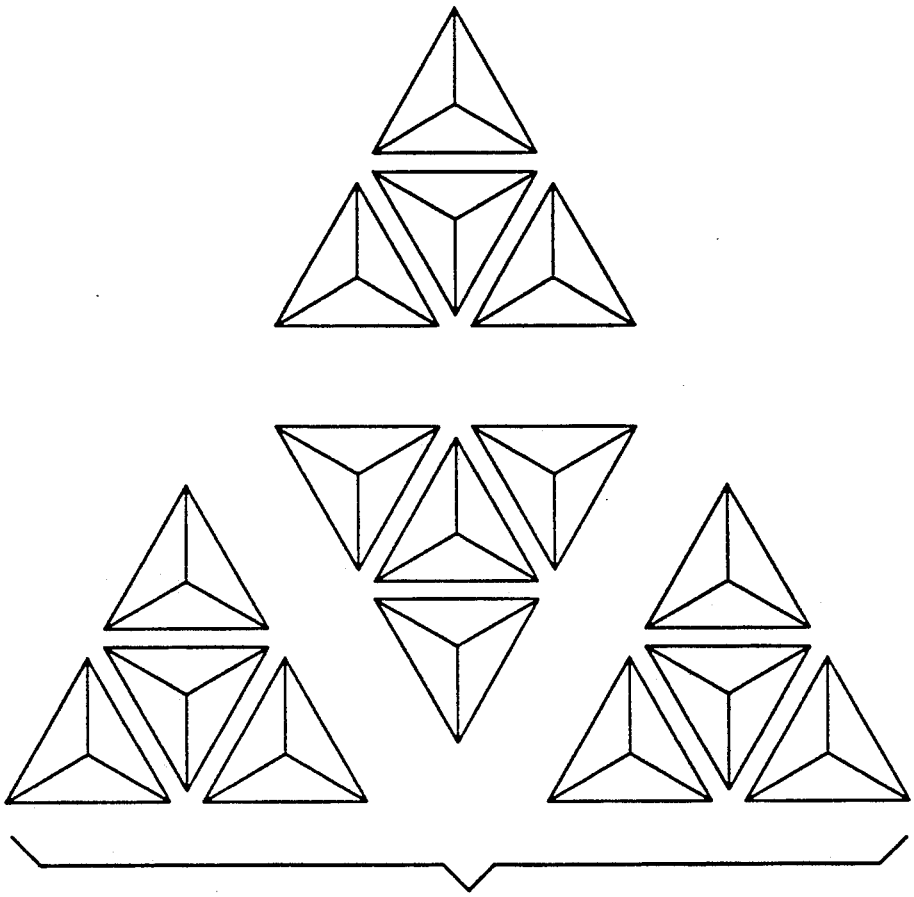

In the fifth preferred embodiment of the invention, FIG. 69, there are only two stages in teh module comprised of four equilateral triangles divided into three isosceles triangles by lines extended from the center point out to each of the three vertices. The modules follow a $3^n$ progression of three spaces units in the first stage and one space unit in the second stage. A game piece that pilots out of any of the outer three modules moves to the second level module in the center space, which is an inverted triangular configuration in relation to the outer three modules. The space units are all identical in shape so that position is the indicia that distinguishes both level one from level two space units of a given player, and also distinguishes one player's space units from another. Color or pattern might also be used to further clarify these distinctions, but are not necessary. There are three players in this game; each player's group of space units share sides with the other players' space units, i.e. the inner two sides of a space unit of one player are coincident with one side each of one space unit each of the other two players, within the bounds of each equilateral triangle. Each grouping of four equilateral triangles is therefore actually three modules combined, one for each player.

Figure 71:
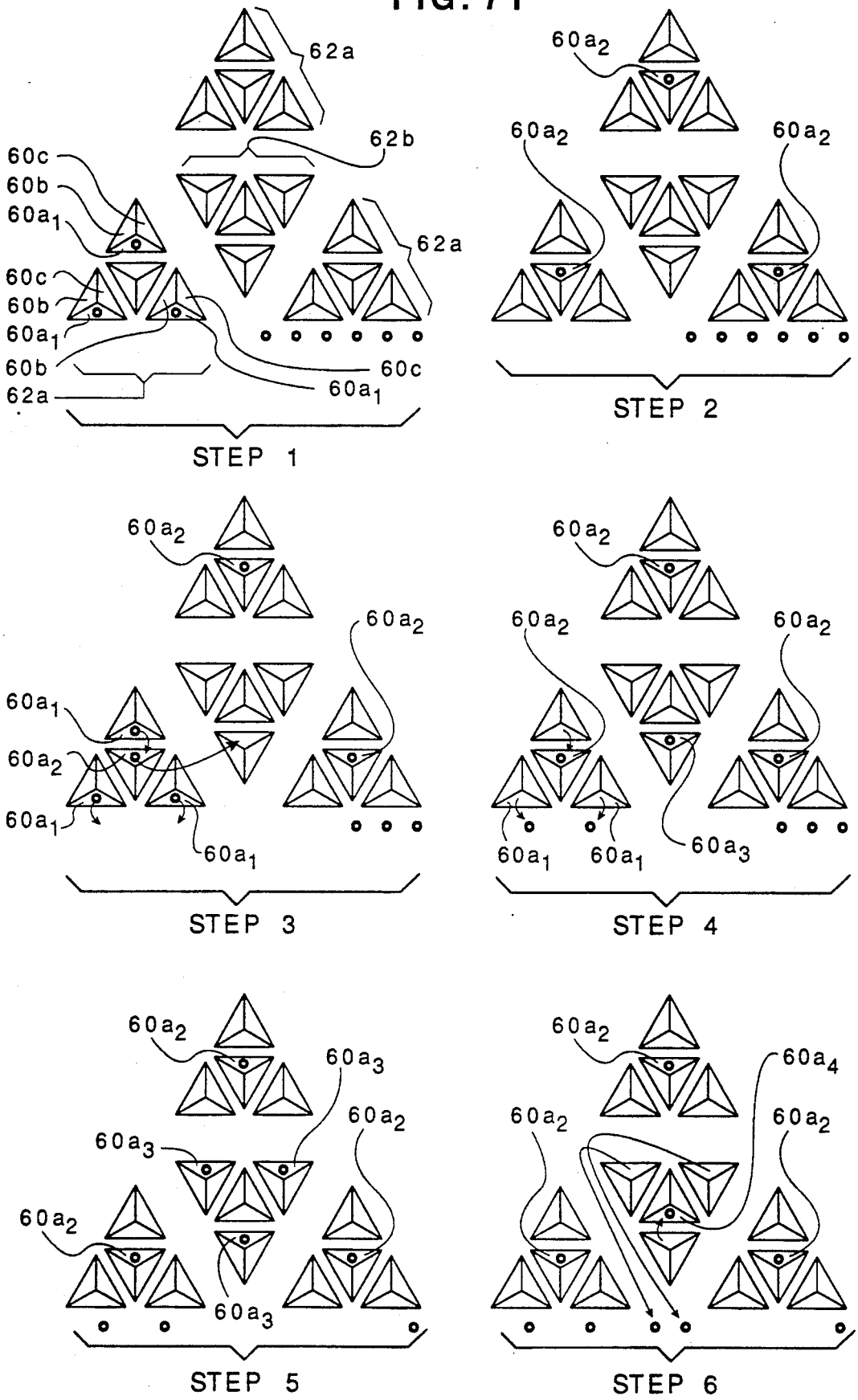
FIG. 71 is a diagramatic illustration showing the sequence of steps in the play of a game using the game board of FIG. 69.

FIG. 71 shows the sequence of steps for one player's moves in the play of the game board of FIG. 69. The space units 60*a* of the player being shown have space unit triangles which point vertically up in stage one, level one (60$a_1$) and point down in stage two, level one (60$a_2$) In level two in the central area of the game board, that player's space units point down in stage one (60$a_3$) and up in stage two (60$a_4$), just the opposite of level one. The second player's space units (60*b*), similarly, point diagonally up to the left and diagonally down to the right; vice versa diagonally for the third player (60$_c$). Referring now to the sequence of plays, in step 1 the first player has filled stage one and is ready to split and move each of the three game pieces up on the three modules, as in step 2. In step 3, one of the modules is chosen to repeatedly fill the first stage and each time a game piece is piloted out and played on the central, second level module, as shown in step 4. Step 3 and 4 are followed three times to pilot out three game pieces to fill the stage 1 of the level two module, as shown in step 5. Next the center module splits and, since there is only one module, the secondary process (compare FIG. 39) is used so that two game pieces come off the board and one game piece moves up to the stage two (pilot) position, as shown in step 6. Steps 3–6 would then be repeated twice more until the pilot in the center module can pilot out. That game piece is then eligible to play on stage 1, level 1 of either of the other player's modules, as in the game sequence of FIG. 68. The player who first pilot's out of one of an opponent's first level modules is the winner. A short version of the game omits the second level central modules entirely, so that a game piece that pilots out of the first level is immediately eligible to play on an opponent's module and the first to do so and pilot out there on will win.

Figure 72:
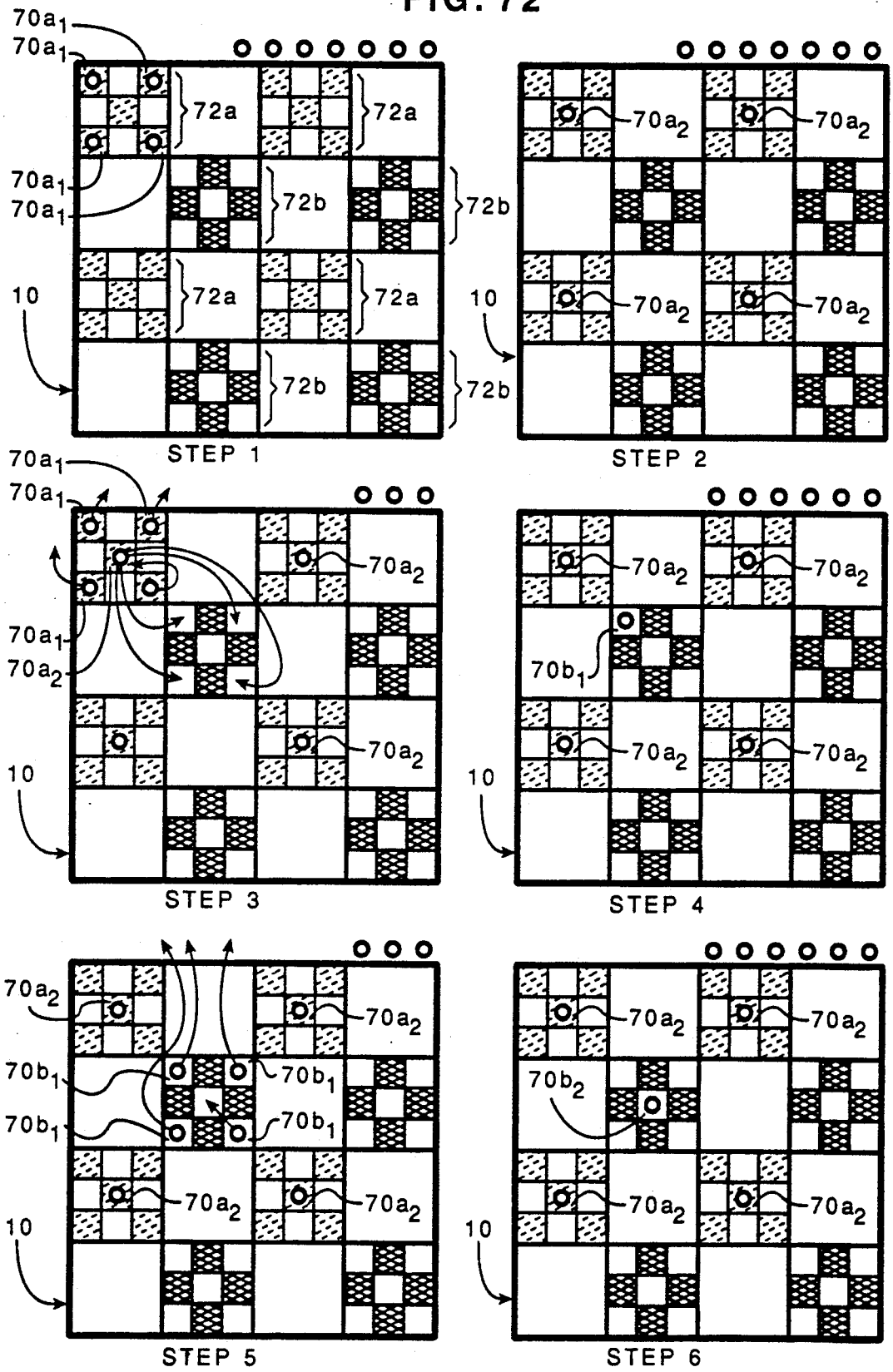
FIG. 72 is a diagramatic illustration showing the sequence of steps in the play of a game using the game board of FIG. 70.

In the sixth preferred embodiment of the invention, FIG. 70, there are again only two stages per module but a $4^n$ progression is used with four space units in stage one and one space unit in stage two. The game is for two players and there are four modules (72*a* & 72*b*) per player. Player modules do not share sides but the overall square configurations of each player's four modules do overlap. Again, the object of the game is to pilot out of one of the opponent's modules. There is no second level for each player other than the modules of the opponent, unless the white spaces between shaded space units are utilized, as they so may be. FIG. 72 shows the sequence of steps for one player's moves in the play of a game using the game board of FIG. 70. Step 1 shows the filling of stage one (70$a_1$); step two shows the result of the first split (70$a_2$); step 3 shows directional arrows for the movement of game pieces in the second split which includes a piloting out, with arrows indicating also the movements of the subsequent three piloting out pieces onto the opponent's module; step 4 shows the result of that second split (70$b_1$); step five shows the result of the first split on the opponent's module and directional arrows for each game piece's subsequent movement, and step six shows the result of that split and one game piece moving to pilot position (72$b_2$) on the opponent's module. Play continues until one player pilots out one of his own game pieces on the opponent's module.

Figure 73:
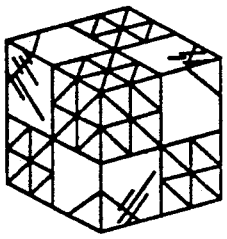
FIG. 73 is an isometric view of the game board of FIG. 46, applied to the surfaces of a cube, upon which three sides with a common vertex form one game board, and another identical or similar game board is applied to the remaining three sides that are hidden from view.
Figure 76:
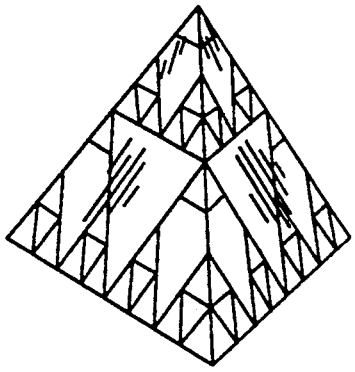
FIG. 76 is a perspective view of a game board using the modules of the game board of FIG. 37, arranged in two levels, and applied to the surface of a tetrahedron.

FIG. 73 and FIG. 76, as stated in the drawing descriptions, show how the game boards of FIGS. 46 and 37 respectively may be applied to the surfaces of three-dimensional objects, namely a cube and a pyramid based on a triangle (a tetrahedron). In the case of the cube, all hidden sides would be used for a second, identical game board layout; whereas on the tetrahedron, the base would presumably not be used, although the base could be used for a fourth player. If the game board of FIG. 49 were applied to the surfaces of the tetrahedron, a multi-directional playing area would result, similar to FIGS. 78 and 79, but without the use of internal sides. It should also be noted that any of the game boards with an overall equilateral triangular configuration could be applied to the surfaces of a tetrahedron, or any pyramid based on any polygon up to five sides, with play excluding the base, unless a different game board is used there on. (A six-sided regular polygon, i.e. a regular hexagon, would flatten the corresponding six equilateral triangles into itself and thus be a two dimensional game board like FIG. 37.) Furthermore, any equilateral triangular game board configurations could similarly be applied to the surfaces of the folding hexagonal game board or six-point star folding game board of FIG. 86. In all of the above cases, velcro or magnetic means of adherence of game pieces to the sides of the game boards may be used, or the use of a computer screen, or flat vinyl plastic game pieces and board surface which adhere well to each other, or other means of adherence may be used.

Figure 86:
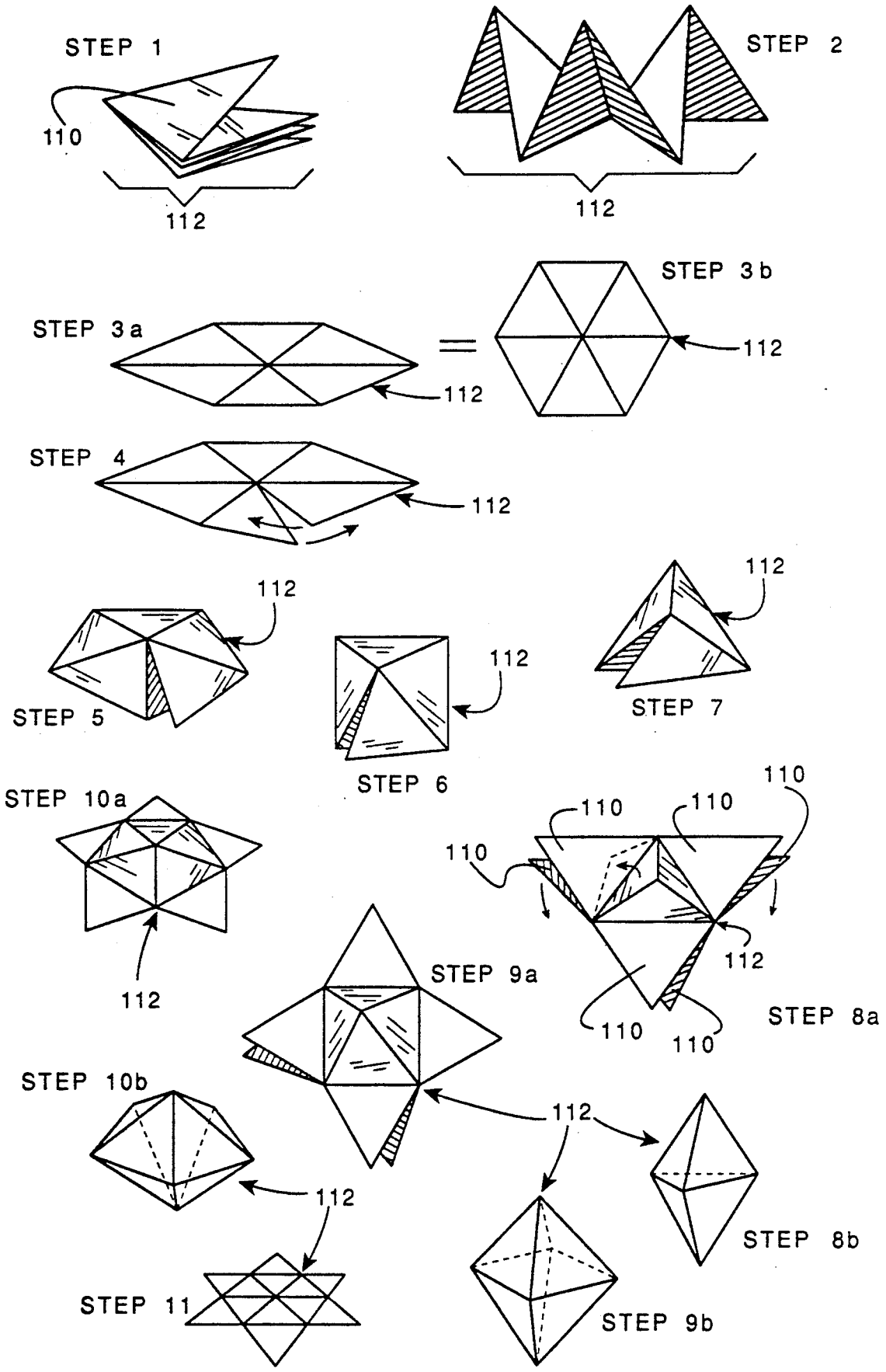
FIG. 86 is a diagramatic illustration showing the sequence of steps in folding and unfolding a specially designed hexagonal game board.

In addition to the above applications of the folding hexagonal and star pattern game board of FIG. 86, that folding game apparatus is an invention independent of the present invention, and may be used to enhance the play of any game board or play area means with an equilateral triangular playing area configuration; and said folding game board is intended for patent application independent of the present invention, and the said folding game board's initial claim for patent is heretofor made.

Turning now to FIG. 86, the sequence of steps in folding and unfolding the hexagon and/or star pattern game board 112 are illustrated with perspective views. In step 1, the apparatus is completely folded except for one triangle 110 beginning to unfold from the rest. In step 2, the apparatus is unfolded enough to exhibit a three-dimensional zig-zag configuration. In step 3*a*–3*b*, the loose ends are joined as the apparatus is pulled around into a flat hexagon. Step 3*b* is an aerial view of the perspective view of step 8*a*. In step 4, one triangle is moved down and directional arrows indicate the direction the two "loose ends will be pulled each time a pyramid of fewer and fewer sides is desired. Step 5 shows the resulting pyramid of five triangles based on a pentagon. Step 6 shows that the next infolding creates a pyramid of four triangular sides based on a square. Step 7 shows that the next infolding creates a tetrahedron. Where the triangular sections of the folding apparatus are very thin and the joints are flexible enough, the next infolding creates the essentially flat folded position of step 1, except the latter is presumed from a view of step 2 to be folded in alternating directions, i.e., accordion style. If the triangular sections of the apparatus have an appreciable thickness, then further infolding beyond the tetrahedron in either not possible or a function of henges or joints that accommodate such folding.

Continuing with the sequence in FIG. 86, step 8*a* shows the downfolding of additional triangular sections 110, i.e. if the apparatus completely unfolded is a six point star (step 11) rather than simply a hexagon (step 3). Step 8*b* shows the resulting polyhedron comprised of two tetrahedrons joined base to base if the downfolded triangles of step 8*a* are folded down far enough to join edges with each other. In step 8*a*, the downfolded triangles are laid flat on a table or other flat surface to form a three-point star, i.e., an equilateral triangle inscribed with the base of a tetrahedron. The triangular dotted line indicates a triangular section 110 as it is just beginning to be turned down. The broken line arrows indicate the direction of down folding to create step 8*b*. Step 9*a* shows the four-point star inscribed with the square base of the pyramid of step 6, and step 9b shows the octahedron formed if the star points are folded down to join edges with each other. Step 10*a* shows the five-point star inscribed with the pentagonal base of the pyramid of step 5, and step 10*b* shows the ten-sided polyhedron formed if the star points are folded down to join edges with each other. As previously stated, step 11 shows the six-point star completely unfolded.

Figure 77:
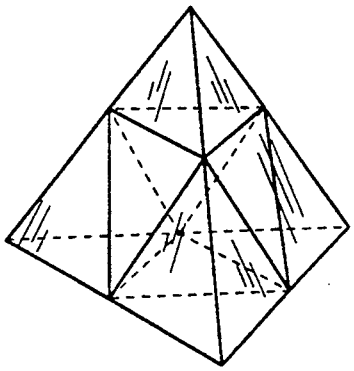
FIG. 77 is a perspective view of a transparent version of the game board of FIG. 35, in which the playing area is a solid structure rather than four pyramids (tetrahedrons) joined, and in which the playing area includes the internal sides created by the inscribed octahedron.
Figure 75:
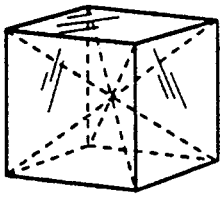
FIG. 75 is a perspective view of a module or game board according to the present invention, which comprises a cube dissected into six pyramids based on the faces of the cube, with each apex at the center of the cube.

FIG. 74 is a cube inscribed with a tetrahedron; FIG. 75, a cube dissected into six pyramids based on the faces of the cube; FIG. 77, a tetrahedron inscribed with an octahedron; and FIGS. 78 and 79, two different perspective views of sets of four FIG. 35 tetrahedrons joined together to form a larger tetrahedron. FIGS. 74, 75, 77, 78 and 79 are particularly suitable game boards for play on a computer screen, where the component parts of the three-dimensional images may be separated out, enlarged, reduced, highlighted with different colors or other indicia on the edges or vertices in different colors or other indicia on the edges or vertices at different steps of play, even though some edges represent coincident space units of more than one player module. The above game boards may also be constructed of three-dimensional objects that come apart to access internal sides and coincident edges and vertices, like a three-dimensional puzzle.

Figure 78:
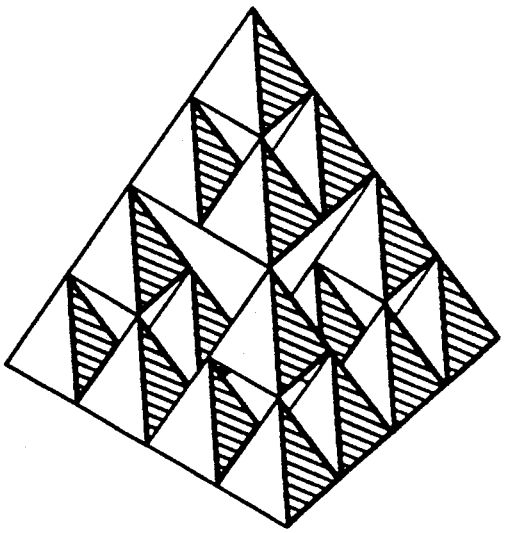
FIGS. 78 and 79 are two different isometric views of one preferred three-dimensional embodiment in the detailed descriptions which follow.
Figure 79:
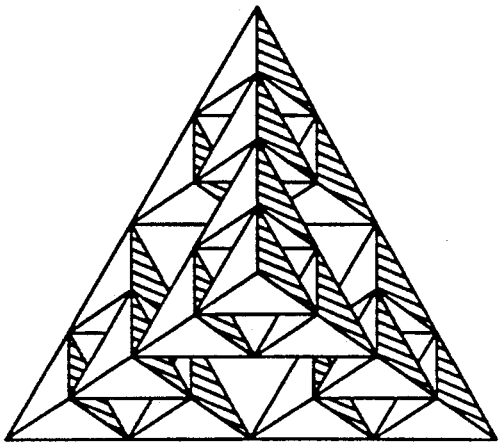
Figure 80:
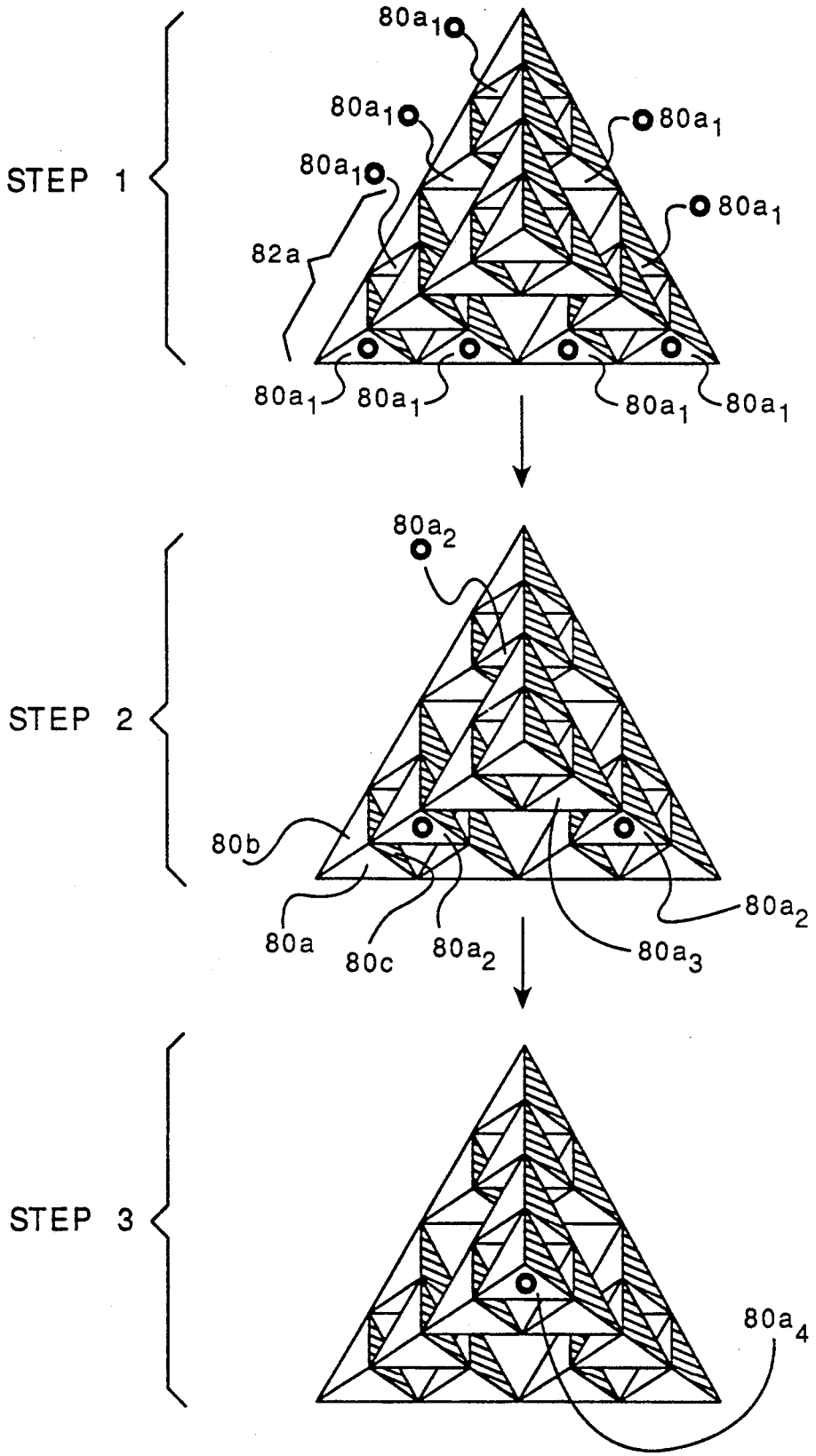
FIG. 80 is a diagramatic illustration of the sequence of steps in the play of the game board of FIG. 79.
Figure 81:
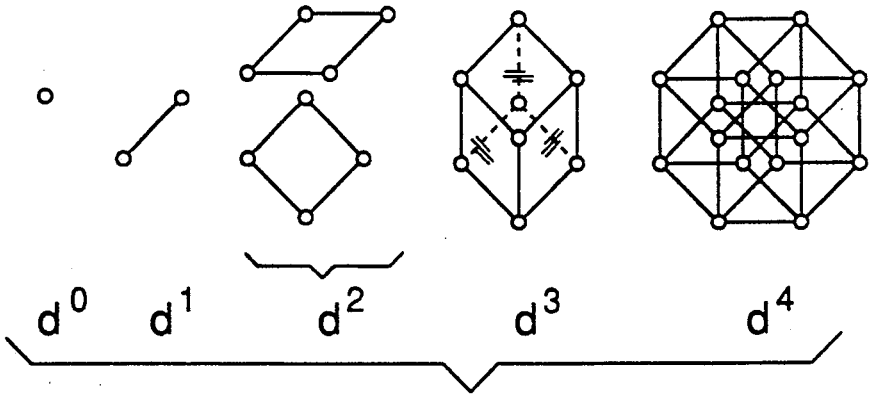
FIG. 81 shows the progression of dimensions from a zero-dimensional point to a four-dimensional hypercube shown as a measure polytope, i.e., with all edges shown of equal length, the game board in accordance with the present invention being the hyper-cube, the modules being the eight three-dimensional cubes that comprise the hypercube, the space units being the sides of each cube; the hypercube being a preferred embodiment for use on a computer screen.

FIG. 80 shows the sequence of steps in one player's moves in a play of the game of the preferred embodiment illustrated in FIGS. 78 and 79. In step 1, the nine stage 1 space units 80$a_1$ of one player's module are shown played by round black dots representing game pieces. In Step 2, a split has occurred and one group of three game pieces has moved up to the 80$a_2$ position (stage 2) while the other two groups of three game pieces have either been removed from the module under the secondary process or moved to other modules not shown if more than one overall pyramid is used for the playing area means. Then in step 3, it is important to note that 80$a_3$ space units have been bypassed—this is a gameboard with five-directional capability (compare FIG. 35) and except in the case of the central direction, the second row of space units from the "top" (the top being in the direction of choice) are omitted so that there are three stages in use. Therefore, in step 3, there is only one stage 3 space unit 80*a* 4 as shown played with a black dot, representing the one of the three game pieces that moved up after the step 2 group splits.

Figure 83:
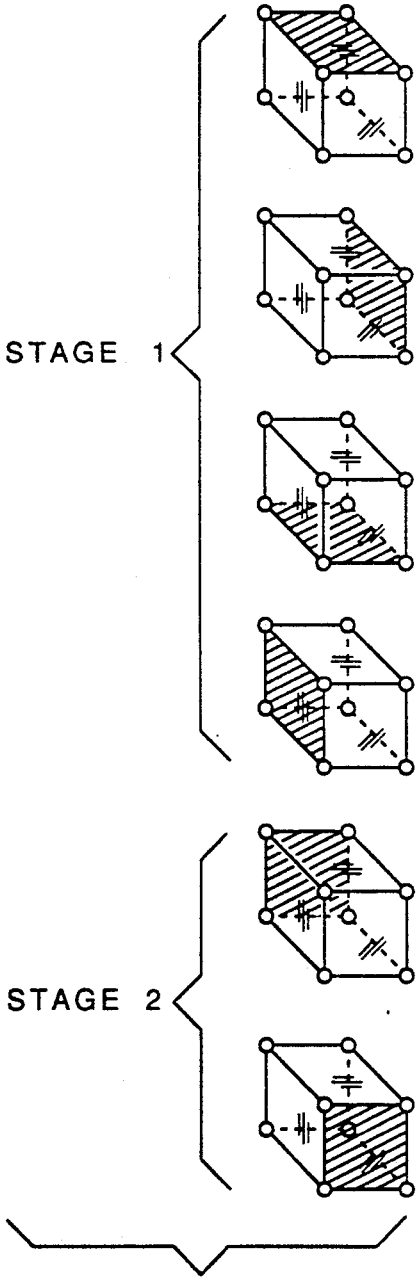
FIG. 83 illustrates by shaded sides of the four space units of stage one and two space units of stage two of one of the cubes of FIG. 82, the third stage being the cube as a whole.
Figure 82:
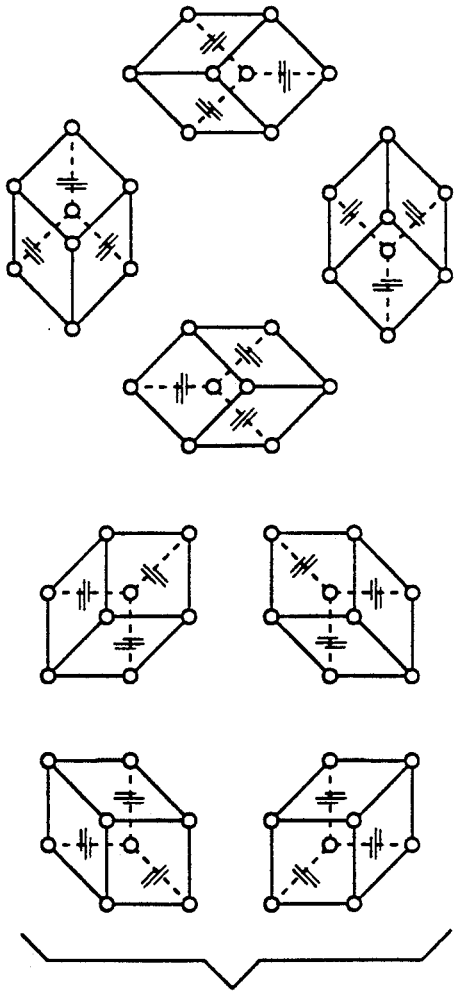
FIG. 82 shows the eight cubes separated out from the game board of FIG. 81*d*$^4$.

FIGS. 81–83 show the preferred embodiment of the hypercube and its component dimensional parts ($d^o$, $d^1$, . . . $d^4$), primarily for use as a multi-dimensional playing area means on a computer screen. Four-plus dimensions may be represented in a two dimensional plane by use of polytopes or "hypersolids", i.e., projections of the four-plus dimensional figures onto hyperplanes by rotation, reflection, or any other transformation. Instead of or supplemental to the computer screen, three-dimensional models may be used, comprised or rods of any suitable material joined at their endpoints to represent the edges and vertices of the hypersolids intended for use as the game board modules. Rotation or other transformation of the image would then be done manually. In the preferred embodiment of the hypercube, there are 16 vertices, 32 edges, 24 faces, and 8 cells or cubes represented by oblique parallel projection (the latter are separated out in FIG. 82). FIG. 83 illustrates by shaded sides the four space units of stage one and the two space units of stage two of one of the cube modules of FIG. 82, the third stage being the cube as a whole.

Figure 53:
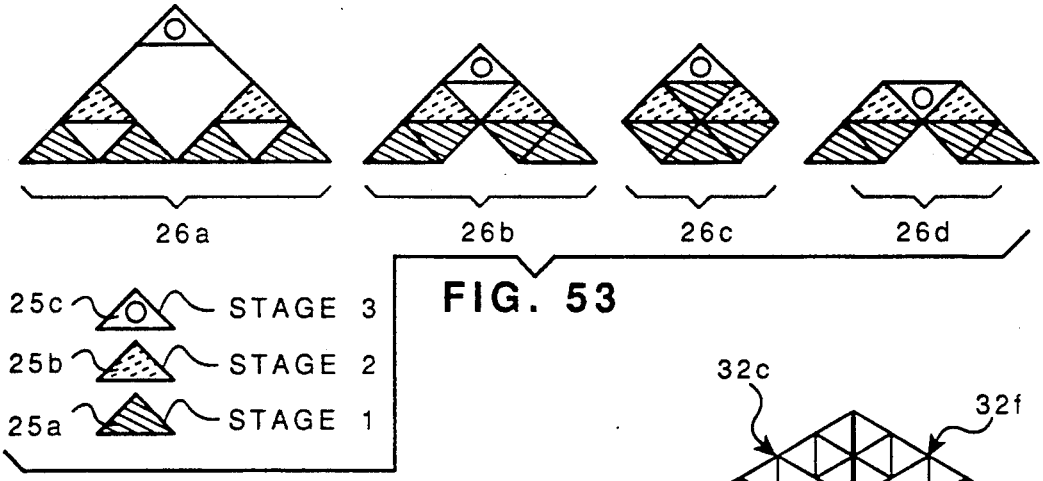
FIG. 53 shows plan views of one "unfolded" module and three viarations of "folded" modules from the same source module.
Figure 84:
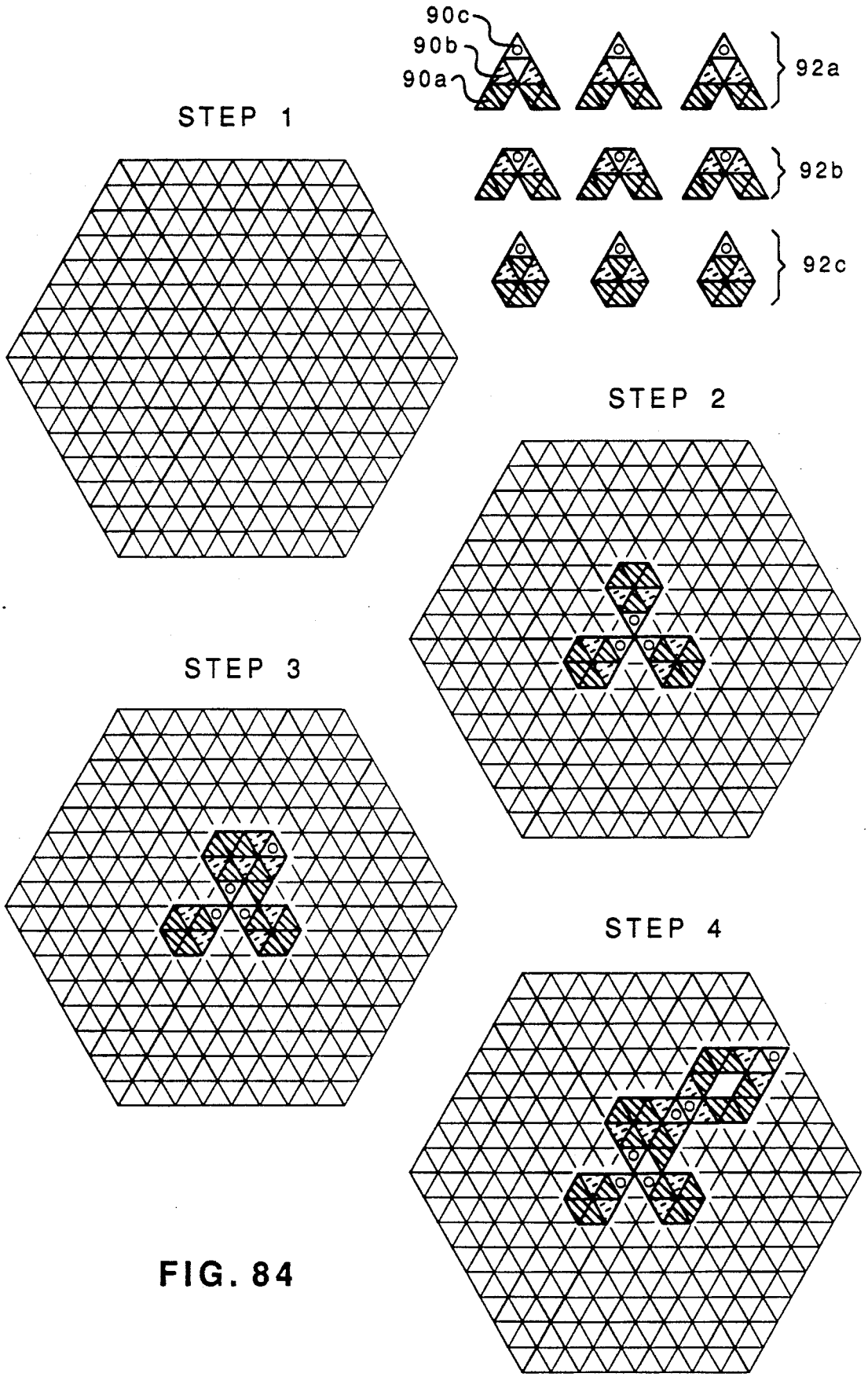
FIG. 84 is a diagramatic illustration of a preferred embodiment showing the sequence of steps in the play of a game using an open grid playing area combined with movable modules each of which may or may not be foldable into any of three configurations, the modules being similar to those pictured as 26*b*, 26*c*, and 26*d* in FIG. 53.

FIG. 84 shows a preferred embodiment of the present invention with the sequence of some of the possible steps in the play of a game using an open grid playing area means combined with movable modules, each of which may or may not be foldable into any of three configurations 92*a*, 92*b* and 92*c*; the modules being similar to those pictured as 26*b*, 26*c* and 26*d* in FIG. 53. Because of the movable and foldable aspects of these modules, the indicia determining stages and player-identified modules corresponding to respective player game pieces are indicia other than position, such as color or pattern. In the illustration FIG. 84, one player's modules 92*a*, *b* and *c* chave stage one space units in black, stage two space units in diagonal line shading, and stage three space units in white with a circle. It is also workable to have the same modules for all players. In either case the object of the game is to be the first to reach the periphery of the open grid game board. Step one shows the open grid board by itself. Step 2 shows three modules 92*c* positioned for play around the center point of the game board. Step 3 shows a module 92*b* that has been positioned overlapping one of the modules 92*c*, the rule being that once a first module such as a 92*c* in the center area is full, its game pieces split to play also on another module that must be added base-to-base, apex-to-apex or overlapped as shown in step 3. Step 4 shows the addition of one 92*b* module and one 92*a* module added in the prescribed manner, and reaching the periphery of the game board.

It is important to note that in the play of the game of FIG. 84 in particular but also in any of the other embodiments of the present invention, an alternate set of rules may be used if enough game pieces are available, such that instead of splitting, moving up and piloting out, the modules may be filled one stage at a time with game pieces that then remain on the game board, with additional game pieces then played on the next module, joined the first apex-to-apex, base-to-base, overlapping or according to some other guideline, usually resulting in playing stages in alternating order, i.e., stage 1 then stage 2 than stage 3, then on the next module adjoined playing stage 3 then stage 2 then stage 1, and so on; creating a new pattern on an open grid board each time the game is played, or filling all or some of the modules of a game board with a fixed module pattern. The object of such versions of games of the present invention is usually to be the first to reach the center, the periphery, or the opposite side of the game board before an opposing player does. In these versions of the present invention, the $2^n$, $3^n$, and $4^n$ etc. geometric progressions of game piece movement through stages is retained although the primary and secondary processes are not.

Another adaptation of the present invention is to play game pieces with indicia such as color that distinguish both players and stages of player game pieces on an open grid game board, either without the primary and secondary processes as in the previous discussion where modules are built upon each other, or with primary and secondary processes such that splitting and moving up entails moving one half of the split as usual over to another module, but a module which is formed by the game pieces moved, which are moved over to the nearest or any group of open grid spaces that may accomodate a full module without touching, overlapping or otherwise infringing on the space requirements of modules that have already been started.

Figure 85A:
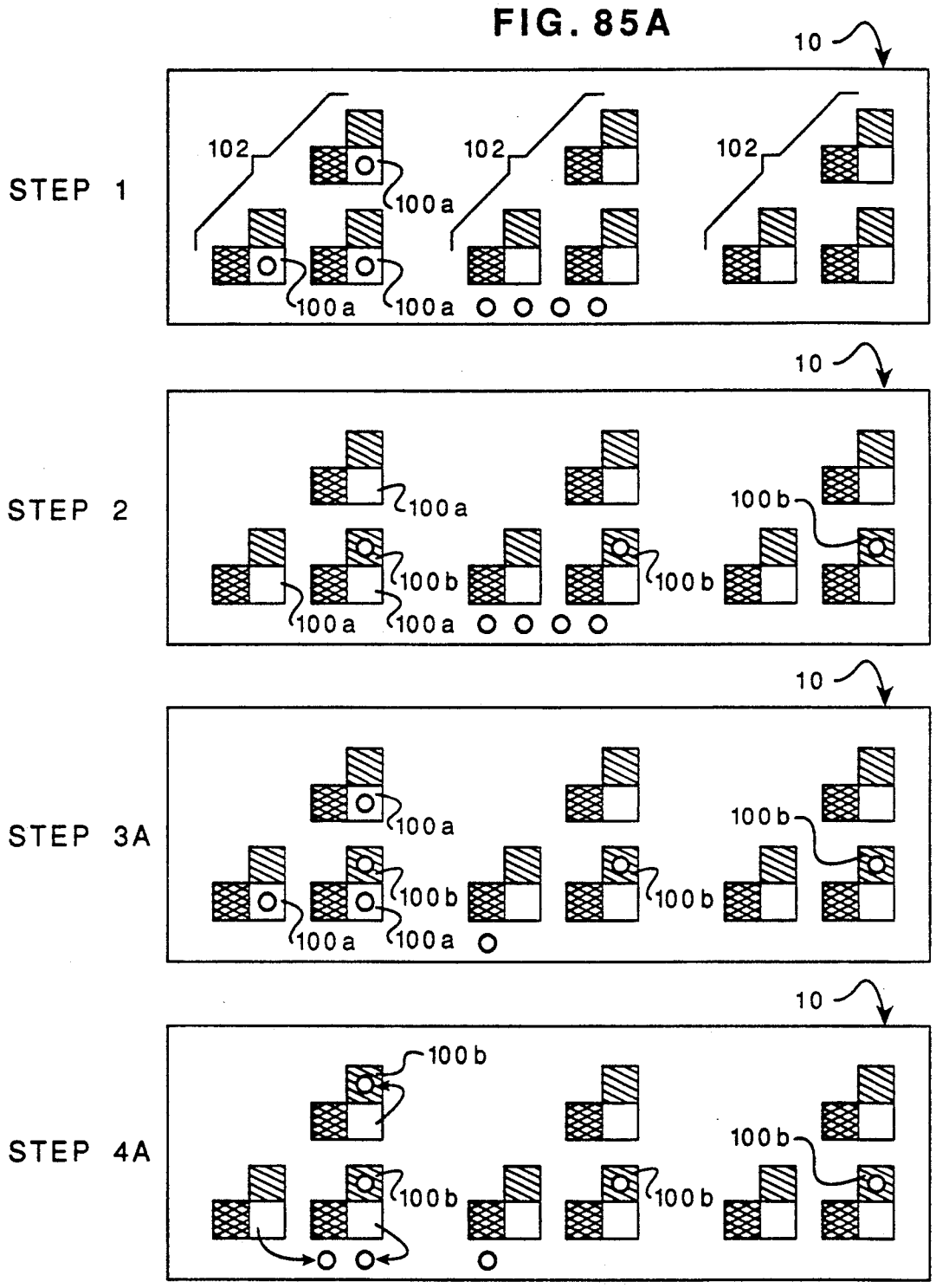
FIG. 85 is a diagramatic illustration of a preferred embodiment showing the sequence of steps in the play of a game using a game board with modules comprised of the simplest folded grouping of upright squares pictured as 28*b* in FIG. 52, in which each stage of the module is the 2nd stage for the previous player and the third stage for the next player, in a game with three players.

FIG. 85 shows a preferred embodiment of the present invention using modules comprised of the simplest "folded" grouping of upright squares pictured as 28*b* in FIG. 52. In the FIG. 85 game, each stage of the module 102 is the second stage for the previous player and the third stage or second level first stage for the following or third player in a game with three players. A fourth square with separate indicia could be added for a fourth player, in which case there would be four stages or two stages in each two levels as well for each player to play. In step one player one has played three game pieces to fill his own stage one on the white space units 100*a* that correspond to the white indicia of his game pieces. In step 2, the game pieces have split and moved up to the shaded spaces 100*b* of the next player in turn, which are stage 2 for the first player. In step 3 one module of the first player (white) is full and ready to pilot out a game piece, which can then play anywhere on a black space 100*c* corresponding to the third player. In steps 4 and 5 the splitting (secondary process), moving up and piloting out occurs, with the piloted out game piece moving to the black space 100*c*. Since this is the alternative of rules in which there are two levels, the first stage of the next level now to be played by the first player in order to pilot out of the second level, is comprised of the black spaces, which can only be played by game pieces that the first player has piloted out of the diagonal line shaded spaces. When three black spaces have been filled, one of the game pieces of player one moves up to stage two, his own original white space, and the first to do so wins.

I claim:

1. A method of playing a game, said method comprising the steps of:

(A) providing game equipment including a plurality of game pieces, the game pieces defining a plurality of sets of game pieces, the game pieces of each set having unique piece indicia distinguishing the game pieces of one set from the game pieces of other sets; and means providing a playing area defined by a plurality of space units, the space units being physically arranged in and defining a plurality of sequential stages, the stages being physically arranged in and defining a plurality of modules, the modules being arranged in and defining a plurality of levels; the number of space units in each sequential stage of a module of a level continuously increasing from a minimum in the last stage to a maximum in the first stage according to a pyramidal geometric progression $K^n$, where K is a number greater than one and n is the inverse sequential number of the stage minus one; the groupings of space units into stages, stages into modules, and modules into levels being done according to play area indicia directing the movement of the game pieces over the playing area; and (B) moving game pieces from one stage to a next stage when all space units of the one stage and all previous stages of the module have been filled, the game pieces on the last stage of that module moving off the module and then being eligible to be moved into the next level and the game pieces of the previous stages being split into at least two separate groups, with one group remaining in that module and moving as a group, each stage to the next stage of that module, and the other group moving as a group, each stage to the next stage of another module, thereby leaving all first stage space units empty and ready to be filled by additional game pieces.

2. The method of claim 1 wherein in step (B), when no fully empty modules remain, said other group is moved off the playing area.

3. A method of playing a game comprising the steps of:

(A) providing game equipment including a plurality of game pieces, the game pieces defining a plurality of sets of game pieces, the game pieces of each set having unique piece indicia distinguishing the game pieces of one set from the game pieces of other sets; each game piece defining at least one space unit and having indicia defining space units in common with all other game pieces of its set; and (B) p.laying game pieces on a playing area to assemble a plurality of physically arranged sequential stages on said playing area, moving game pieces to assemble, a plurality of physically arranged modules on said playing area, and moving game pieces to assemble a plurality of levels on said playing area; the number of space units in each sequential stage of a module continuously increasing from a minimum in the last stage to a maximum in the first stage according to a pyramidal geometric progression K", where K is a number greater than one and n is the inverse sequential number of the stage minus one; the groupings of space units into stages, stages into modules, and modules into levels being done according to physically arrangeable combinations of game pieces according to the space unit indicia on the game pieces as played, the assemblies directing the movement of game pieces over the playing area.

4. The method of claim 3 wherein each game piece defines only one space unit and including the step of moving game pieces from a given stage of a module other than the last stage to a next stage of that module when all space units on the given stage and all previous stages of that module have been filled, the game pieces on the last stage of that module moving off that module and then being eligible to be moved into a next level and the game pieces of the previous stages being split into at least two separate groups, with one group remaining in that module and moving as a group, each stage to the next stage of that module, and the other group moving as a group, preserving space units in their stage groupings, to commence a new module, each stage of the other group becoming the next stage of the new module, thereby leaving all first stage space units of both modules empty and ready to be filled by additional game pieces.

5. The method of claim 3 including the step of having the played game pieces unmoved remain on the playing area at all times and, at least after all space units in all stages of one module have been filled, the newly played game pieces becoming part of an additional module and forming at least one continuous pattern of game pieces on the playing area.

6. A method of playing a game comprising the steps of:

(A) providing game equipment including a plurality of game pieces, and a plurality of space units defining a playing area. the game pieces defining a plurality of sets of game pieces, the game pieces of each set having unique piece indicia distinguishing the game pieces of one set from the game pieces of other sets, the game pieces being adapted to be played on the space units; and (B) playing game pieces on space units of the playing area to assemble a plurality of physically arranged sequential stages, on said playing area, moving game pieces to assemble a plurality of physically arranged modules on said playing area, and moving game pieces to assemble a plurality of levels on said playing area; the number of space units in each sequential stage of a module continuously increasing from a minimum in the last stage to a maximum in the first stage according to a pyramidal geometric progression $K^n$, where K is a number greater than one and n is the inverse sequential number of the stage minus one; the groupings of space units into stages, stages into modules, and modules into levels being done according to physically arrangeable combinations of game pieces in relation to indicia on the playing area.

7. The method of claim 6 wherein the playing area comprises a plurality of modules of equal size and shape, each module physically extending over four parallel rows of space units and having three stages, all but one of the four parallel rows defining the three stages of each module.

8. The method of claim 6 wherein the playing area also defines a plurality of spacer units and a given module is played in different directions by using different functional combinations of the same structural configurations of space units and spacer units to form the sequential stages.

* * * * *